US009941593B2

(12) United States Patent
Ozdemir

(10) Patent No.: US 9,941,593 B2
(45) Date of Patent: Apr. 10, 2018

(54) PATCH ANTENNA AND METHOD FOR IMPEDANCE, FREQUENCY AND PATTERN TUNING

(71) Applicant: MONARCH ANTENNA, INC., Ann Arbor, MI (US)

(72) Inventor: Tayfun Ozdemir, Ann Arbor, MI (US)

( * ) Notice: Subject to any disclaimer, the term of this patent is extended or adjusted under 35 U.S.C. 154(b) by 981 days.

(21) Appl. No.: 13/874,021

(22) Filed: Apr. 30, 2013

(65) Prior Publication Data

US 2014/0320376 A1 Oct. 30, 2014

(51) Int. Cl.
*H01Q 9/04* (2006.01)

(52) U.S. Cl.
CPC ..... *H01Q 9/0442* (2013.01); *Y10T 29/49016* (2015.01)

(58) Field of Classification Search
CPC ... H01Q 9/0421; H01Q 9/0442; H01Q 9/0407
USPC ..... 343/876
See application file for complete search history.

(56) References Cited

U.S. PATENT DOCUMENTS 6,081,239 A 6/2000 Sabet et al.
6,175,723 B1 1/2001 Rothwell, III
6,188,371 B1 * 2/2001 Li ..... H01Q 9/0421 343/741
6,255,994 B1 * 7/2001 Saito ..... H01Q 1/38 343/700 MS
6,509,880 B2 1/2003 Sabet et al.
6,950,629 B2 9/2005 Nagy
7,190,325 B2 3/2007 Nagy
7,385,557 B2 6/2008 Kim
7,558,555 B2 7/2009 Nagy
7,916,096 B2 3/2011 Pawlak
2004/0140936 A1 * 7/2004 Morrow ..... H01Q 9/045 343/700 MS
2005/0153658 A1 7/2005 Nagy
2005/0219142 A1 10/2005 Nagy
2006/0240882 A1 12/2006 Nagy et al.
2006/0284593 A1 12/2006 Nagy et al.
2007/0060201 A1 3/2007 Nagy
2010/0007561 A1 * 1/2010 Bucca ..... H01Q 9/0407 343/700 MS
2010/0069019 A1 3/2010 Nagy
2010/0194663 A1 8/2010 Rothwell et al.
2011/0175791 A1 7/2011 Ozdemir et al.

OTHER PUBLICATIONS

Lynn M. Greetis et al., A Self-Structuring Patch Antenna, Antennas and Propagation Society International Symposium, IEEE 2008, pp. 1-4.

(Continued)

*Primary Examiner* — Daniel J Munoz
(74) *Attorney, Agent, or Firm* — J. Gordon Lewis

(57) ABSTRACT

A patch antenna system comprises a patch antenna having a patch spatially separated from a ground plane, a plurality of shorting pins interposed between the patch and the ground plane to selectively interconnect one or more predetermined fixed locations of the patch to the ground plane. A control module is operably coupled to a discrete RF switch associated with each shorting pin to set the operating frequency characteristic of the patch antenna by selectively connecting the patch to the ground plane through one or more of the plurality of shorting pins.

32 Claims, 10 Drawing Sheets

(56) References Cited

OTHER PUBLICATIONS

Tayfun Ozdemir, Polarization Diversity Cognitive Antenna for WiFi and ZigBee Applications, WAMICON Apr. 21-22, 2009, Clearwater, Fla.
Lynn M. Greetis et al., A Self-Structuring Patch Antenna: Simulation and Prototype, Antennas and Propagation Magazine, IEEE vol. 52, Feb. 1, 2010, pp. 114-123.
Tayfun Ozdemir et al., Smart Antenna Technology for Structural Health Monitoring Applications, Smart Structures/NDE, Mar. 2010, San Diago, CA.

* cited by examiner

| BLOCK LOCATION (mm) | VSWR (DETUNED) | TUNING STATE | VSWR (RETUNED) |
|---|---|---|---|
| 0.05 | 30.4 | 1101 | 1.3 |
| 0.1 | 17.2 | 1000 | 1.3 |
| 0.2 | 10.1 | 0110 | 1.2 |
| 0.5 | 5.5 | 0011 | 1.3 |
| 0.8 | 4.3 | 0011 | 1.1 |
| 1 | 4.1 | 0011 | 1.3 |
| 1.5 | 3.3 | 0010 | 1.1 |
| 2 | 3.1 | 0010 | 1.1 |
| 3 | 2.5 | 0001 | 1.1 |
| 5 | 2.1 | 0001 | 1.0 |
| 10 | 1.5 | 0000 | 1.4 |
| 20 | 1.1 | 0000 | 1.1 |
FIG. 13
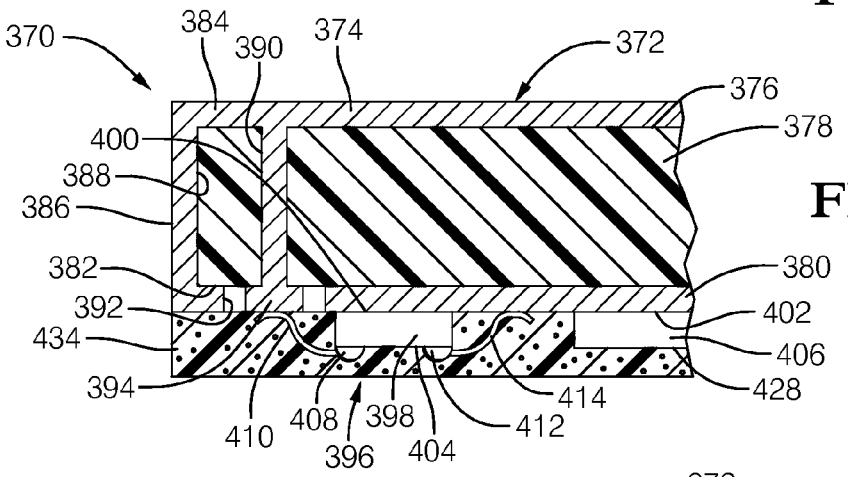
FIG. 14
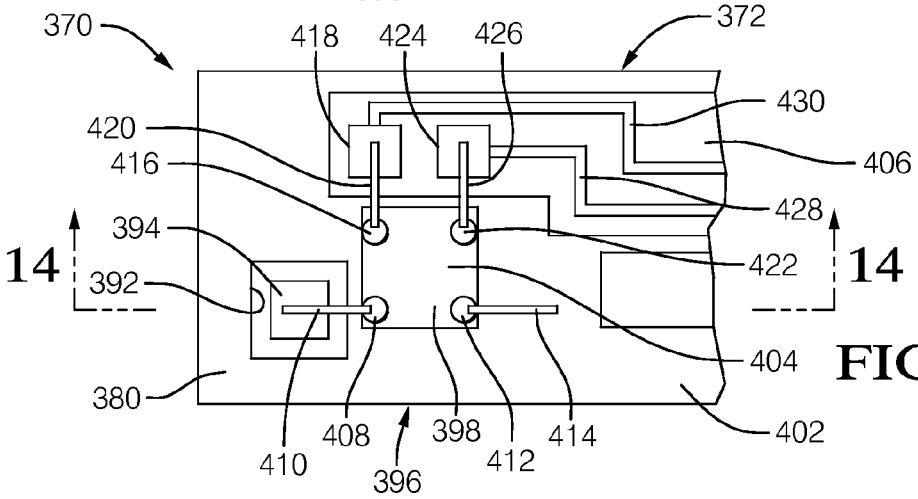
FIG. 15

PATCH ANTENNA AND METHOD FOR IMPEDANCE, FREQUENCY AND PATTERN TUNING

TECHNICAL FIELD

The present invention relates to antennas, and more particularly to patch antennas. More particularly still, the present invention relates to miniaturized patch antennas suitable for impedance, frequency and pattern tuning.

BACKGROUND OF THE INVENTION

A patch antenna is a narrowband wide-beam antenna fabricated by etching the antenna element pattern in metal trace bonded to an insulating dielectric substrate, such as a printed circuit board (PCB), with a continuous metal layer bonded to the opposite side of the substrate which forms a ground plane. Common microstrip antenna shapes are square, rectangular, circular and elliptical, but any continuous shape is possible. Some patch antennas do not use a dielectric substrate and instead, are made of a metal patch mounted above a ground plane using dielectric spacers. The resulting structure is less rugged but has a greater bandwidth. Because such antennas have a very low profile, are mechanically rugged and can be shaped to conform to the curving skin of a vehicle, they are often mounted on the exterior of aircraft and spacecraft, or are incorporated into mobile radio communications devices.

Microstrip antennas are relatively inexpensive to manufacture and design because of the simple 2-dimensional physical geometry. They are usually employed at ultra-high frequencies (UHF) and higher frequencies because the size of the antenna is directly tied to the wavelength at the resonant frequency. A single patch antenna provides a maximum directive gain of around 6-9 dBi. It is relatively easy to print an array of patches on a large (single) substrate using lithographic techniques. Patch arrays can provide much higher gains than a single patch with little additional cost. Matching and phase adjustment can be performed with printed microstrip feed structures, again in the same operations that form the radiating patches. The ability to create high gain arrays in a low profile antenna is one reason that patch arrays are common on airplanes and other military applications.

Patch antennas are commonly used in a number of applications such as telecommunications and radar systems. A patch antenna may have a ground plane and a metallic patch of a predetermined shape disposed parallel to the ground plane. A dielectric may separate the patch from the ground plane. The region between the patch and the ground plane may create a resonant cavity that allows for the radiation of electromagnetic waves.

A patch antenna fashioned in this manner may be easy to manufacture and may have end use advantages compared to other antenna configurations. For example, the ground plane shields the antenna from interference from surrounding lines and electronics, and the antenna may be easily conformed to a surface. The frequency characteristics of a patch antenna are a function of the patch antenna size and geometry, which are generally fixed when the patch antenna is manufactured and the environment into which the manufactured patch antenna is introduced. Many patch antennas may be limited to a single frequency with a narrow bandwidth of only a few percent of the center frequency. It may be difficult to expand the bandwidth of the patch antenna or to operate the patch antenna at multiple frequencies. Moreover, the frequency characteristics of the patch antenna may be changed based on the operating environment or if the patch is damaged.

U.S. Patent Application Publication No. US 2010/0194663 A1 to Rothwell et al. entitled "Variable Frequency Patch Antenna" describes a patch antenna system which comprises a patch antenna having a patch spatially separated from a ground plane. A plurality of pins are interposed between the patch and the ground plane to selectively interconnect the patch to the ground plane. A control module is coupled to the plurality of pins and is operable to set an operating frequency characteristic of the patch antenna by selectively connecting the patch to the ground plane with one or more of the plurality of pins.

U.S. Pat. No. 7,385,557 B2 to Kim entitled "PIFA Device for Providing Optimized Frequency Characteristics in a Multi-Frequency Environment and Method for Controlling the Same" describes a planar inverted-F antenna (PIFA) device and a method for controlling the PIFA device that can provide optimized frequency characteristics in a multi-frequency environment. The PIFA device is provided with a plurality of shorting pins located at different distances from a feeding pin and an antenna switch capable of selecting one of the shorting pins, or is provided with an antenna switch capable of moving a shorting pin to a preset position, thereby adjusting a distance between the feeding and shorting points. Antenna frequency characteristics can be optimized according to a frequency band used at a current location, and the antenna frequency characteristics can be optimally maintained is a multi-frequency environment at any time.

U.S. Pat. No. 6,175,723 B1 to Rothwell, III entitled "Self-Structuring Antenna System with a Switchable Antenna Array and an Optimizing Controller" describes an antenna array defined by a plurality of antenna elements that are selectively electrically connectable to each other by a series of switches, so as to alter the physical shape of the antenna array. The antenna elements include antenna wires, where the wires of adjacent antenna elements are connected by a mechanical or solid state switch. One or more feed points are electrically connected to predetermined locations within the antenna array. A feedback signal from the receiver provides an indication of signal reception and antenna performance. The feedback signal is applied to a computer that selectively opens and closes the switches. An algorithm is used to program the computer so that the opening and closing of the switches attempts to achieve antenna optimization and performance.

U.S. Patent Application Publication No. US 2011/0175791 to Ozdemir et al. entitled "Multi-Beam, Polarization Diversity Narrow-Band Cognitive Antenna" describes a multi-beam, polarization diversity, narrow-band cognitive antenna system. The antenna system includes a plurality of antenna elements, switching elements, and transmission feed lines disposed on a printed circuit board (PCB) substrate, inside or on the enclosure of a consumer wireless device, on the airframe of an air vehicle, or on the surface of a ground vehicle. The plurality of switching elements are arranged with the antenna elements and transmission feed lines to, when selectively closed, electrically couple selected ones of the antenna elements and transmission feed lines to one another to generate an antenna configuration selected from a plurality of antenna configurations. A non-volatile memory is configured to store data representing at least some of the plurality of antenna configurations. A control arrangement is operatively coupled to the plurality of switching elements and configured to selectively close selected ones of the switching elements as a function of the data stored in the memory. Means are provided to selectively update the data as a function of previously selected antenna configurations.

SUMMARY OF THE INVENTION

It is an object of the present invention to provide the design and method of controlling, and a method of manufacturing a tunable half-patch antenna that can be packaged as a surface mount component or embedded into a circuit board. The antenna contains shorting pins distributed across the aperture that are actuated by radio frequency (RF) switches to provide impedance, frequency and pattern tuning within the framework of a self-structuring antenna in a closed loop control environment. Open loop control, with the aid of a lookup table, is also included. Both ohmic as well as reactive switching methods are included. Both digital as well as analog control methods are included. The invention can be utilized for cell phone, machine-to-machine (M2M) communication and other wireless applications where small form-factor surface mount or embedded active is of particular value.

The present invention differs from the patch antenna described in US 2010/0194663 A1 in a number of respects. The design of the present invention is smaller by half in electrical length, and hence more suitable for cell phone and embedded applications. The present invention also describes four options or embodiments for mounting and operating the switches and hence rendering the design commercially feasible, manufacturable and cost efficient:

OPTION 1: An additional board is described for mounting of the switches and for carrying the control signals;

OPTION 2: A hybrid method is described where the switches are mounted directly on the antenna board via either wire-bonds or solder balls and are wire-bonded to traces (carrying the control signals) on a second board, which partially covers the back side of the antenna;

OPTION 3: The switches are sandwiched between the antenna board and the additional board carrying the DC control signals. The RF contacts of the switch are located on one side of the chip and are flip-chip bonded to the antenna board via solder balls and the other side of the switch contains DC control contacts which are similarly flip-chip bonded to the second board carrying the DC control signals; and OPTION 4: An additional monolithic microwave integrated circuit (MMIC) is described for realizing compact switching functionality which is flip-chip bonded to the antenna board. Packaging of the antenna is described for use as a surface mount component. Lastly, a method is described for embedding the compact antenna design into a circuit board that also contains radio (transceiver) and other associated communication circuitry.

The present invention differs from the PIFA antenna described in U.S. Pat. No. 7,385,557 B2 in a number of respects. The design of the present invention has the entire edge of antenna closest to the feed location shorted to the ground plane by way of a metallic plate or a series of plated through vias (separated by a distance that is no larger than one-twentieth of the shortest operating wavelength). As opposed to the Kim device, in the present invention the switched pins can be located anywhere in the aperture of the antenna and not necessarily sequestered along the edge of the aperture. Operation of the antenna in the present invention differs fundamentally from the Kim device, in that the Kim device only switches one pin to ground at a given time. By contrast, in the present invention, two or more pins can be simultaneously switched to ground at any given time. Restated, the present invention can have a selectable plurality of the pins "active", and the rest "non-active" at any given time.

According to one embodiment of the invention, a patch antenna system includes a patch antenna having a patch, a ground plane, and a dielectric interposed between the patch and the ground plane. At least one feed pin is electrically coupled to the patch for transmitting and/or receiving signals and a plurality of shorting pins are disposed in the dielectric which are electrically coupled to the patch. Some or all of the plurality of shorting pins extend within an opening in said ground plane to form a contact pad at a terminus thereof adjacent and electrically isolated from said ground plane. A plurality of switches, are provided wherein each switch has first and second switch contacts electrically connected to the ground plane and to an adjacent contact pad of an associated shorting pin, respectively. Finally, a control module is arranged in communication with the plurality of switches, and operates to reconfigure the patch antenna by selectively electrically connecting one or more of the plurality of shorting pins to the ground plane. The antenna described herein can be efficiently manufactured as a "surface mount" component and mounted on a circuit board using standard circuit assembly methods.

According to another aspect of the invention, an RF communication device includes a transmitter and/or receiver circuit assembly having a substrate and a plurality of electrical/electronic components and conductors carried on the substrate. A patch antenna is integrated within the same substrate. The patch antenna has a patch, a ground plane, and a dielectric interposed between the patch and the ground plane, with at least one feed pin electrically coupled to the patch for transmitting and/or receiving signals from/to said circuit assembly. A plurality of shorting pins are disposed in the dielectric and are electrically coupled to the patch, with each of at least a subset of said plurality of shorting pins extending within an opening in said ground plane and forming a contact pad at a terminus thereof adjacent and electrically isolated from said ground plane. A plurality of switches, are provided wherein each switch has first and second switch contacts electrically connected to the ground plane and to an adjacent contact pad of an associated shorting pin, respectively. Finally, a control module is in communication with the plurality of switches, and is operable to reconfigure the patch antenna by selectively electrically connecting one or more of the plurality of shorting pins to the ground plane.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which:

FIG. 13, is a table of VSWR of the detuned antenna (no compensation) and the retuned antenna (with compensation) as well as the switch logic states that bring the antenna back to tune, wherein the low VSWR numbers of the retuned antenna attest to the quality of recovery from detuning, and antenna recovery from extreme detuning levels (going from a VSWR of 30.4 to 1.3);

FIG. 14, is a broken, cross-sectional view of a sixth embodiment of a patch antenna, similar in some respects to the embodiment of FIGS. 6 and 7, but on a larger scale and wherein the switch die is directly bonded to the lower surface of the ground plane and the switch contacts are directly wire bonded to the shorting pin and the ground plane;

FIG. 15, is a broken bottom view of the patch antenna of FIG. 14 illustrating wire-bonding of the DC control contacts to adjacent PCB contact pads as well as RF switch contacts to the ground pin and ground plane;

Figure 1:
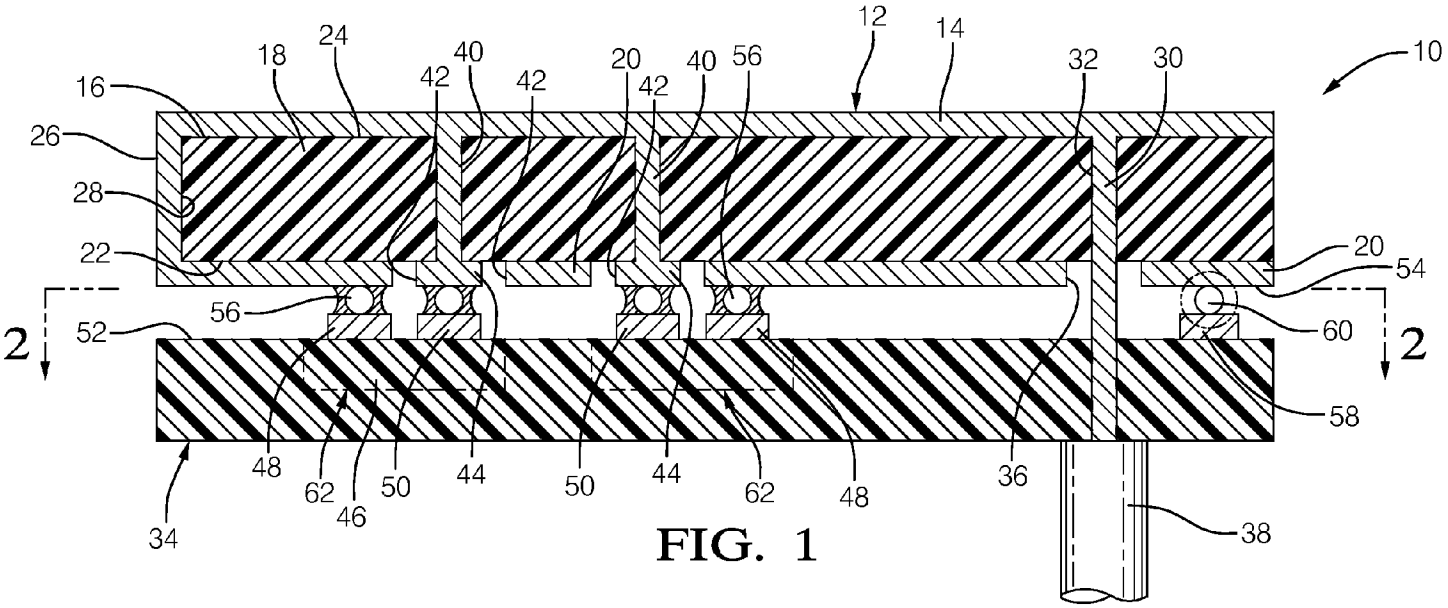
FIG. 1, is a cross-sectional view of a first embodiment of a surface mount, half-patch antenna containing multiple shorting pins on its aperture closely coupled to a common monolithic microwave integrated circuit (MMIC) composite switching device operable for impedance, frequency and pattern tuning.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENT

The present invention provides for compensating against detuning of embedded antennas in portable electronic devices such as cell phones that often result from holding the phone in particular fashion or placing the phone in a pocket (close to skin) or near a metal object. This is because the embedded antennas are always resonant antennas, which are very easily detuned due to the presence of materials near the radiating elements that interact with the fields in the near field area. This is a common problem with handheld devices and can result in a very large change in antenna input impedance, which causes a loss of sensitivity and loss of power amplifier efficiency.

The conventional approach to dealing with the issue of antenna detuning from external influences is to place an active tuning network between the antenna and the transceiver. This tuning network analyzes the link performance and/or circuit voltage standing wave ratio (VSWR) and dynamically adjusts the impedance match. Unfortunately, with antennas of moderate to narrow bandwidths, this requires that the tuning element must tune over a wide range of impedance values as the antenna looks extremely reactive and varies quickly vs. frequency. This requires a tuning network that would have to tune over a large percentage of the Smith chart. In addition, the loss of the tuning network is approximately proportional to the amount of mismatch that it is attempting to match over.

An alternative method would be to adjust the resonant frequency of the radiating element to pull it back to the desired frequency and impedance value. By trimming the frequency rather than the impedance value, one would not require a complicated matching network to match over a very wide range of values. Further, the frequency detuning of an antenna is a moderately predictable behavior, where the absolute impedance of a resonant antenna that has been detuned tends to vary significantly. When used in conjunction with the matching network, the resulting loss from the matching network is much less since it is not attempting to tune over very large mismatch values.

The proposed technology is applicant's Self-Structuring Antenna (SSA), which is a reconfigurable aperture controlled by RF relays placed strategically across the aperture to provide, frequency, impedance, and pattern tuning. Since we are dealing with a detuning problem here, the present invention only focuses on the frequency and impedance tuning features of SSA. The present invention provides the design and method of controlling, and a method of manufacturing a tunable half-patch antenna that can be packaged as a surface mount component or embedded into a circuit board common with the transceiver electronics of a handheld device such as a cell phone. The antenna contains shorting pins that are actuated by radio frequency (RF) switches to provide impedance, frequency and pattern tuning within the framework of a self-structuring antenna. Both ohmic as well as reactive switching methods are included. The invention can be utilized for cell phone, machine-to-machine (M2M) communication and other applications where small form-factor surface mount or embedded active is of particular value.

The invention provides a number of critical features and functions:

Simultaneous tuning of antenna impedance, frequency and pattern or tuning of all three attributes one at a time;

No external tuning element (such as an impedance tuning circuit) is needed;

Compensation for detuning (caused by near field loading, i.e., an object coming in close contact with the antenna);

Polarization and Pattern Diversity;

Transmit and Receive MIMO through use of different polarization, frequencies or patterns or both;

Can be operated in compliance with current RF front end module control interfaces such as RFEE or MIPI; and Can be operated in close loop through self-structuring antenna arrangement or open loop through a look-up table for antenna states.

Figure 2:
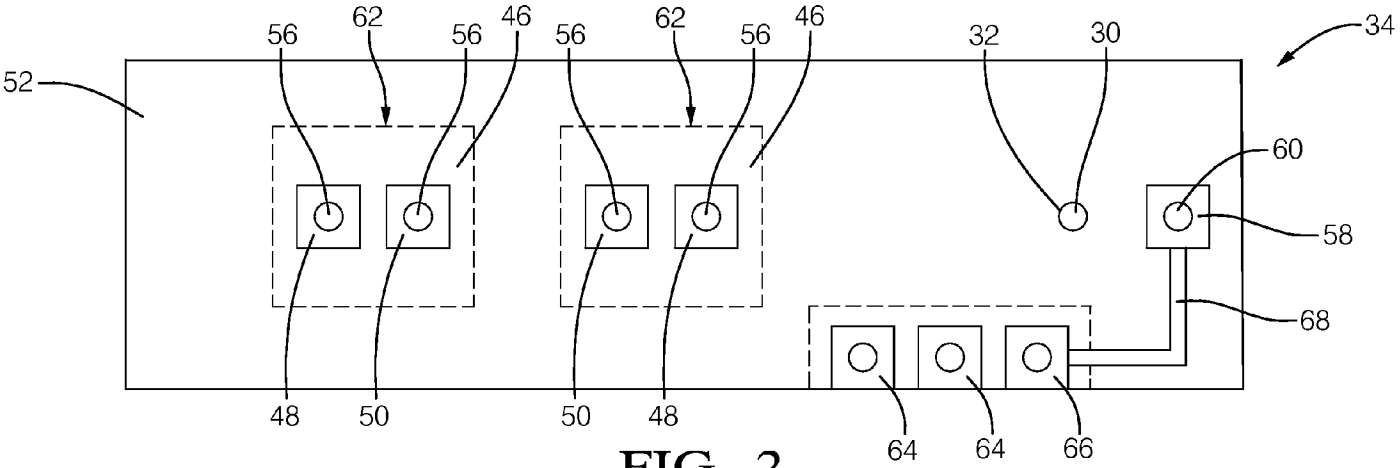
FIG. 2, is a top plan view of the MMIC of FIG. 1 illustrating the active silicon switch regions of the MMIC device.

FIGS. 1 and 2 depict a patch antenna system 10 comprising a patch antenna 12 including a conductive patch 14 mounted on the upper surface 16 of an insulating dielectric member 18, and a conductive ground plane 20 mounted on the lower surface 22 of the dielectric member 18. The ground plane 20 is, thus, spaced from and parallel to the portion of the patch 14 disposed on the upper surface 16 of the dielectric member 18. The antenna 12 is configured as a "half-patch" wherein the patch 14 includes a first portion 24 carried on the upper surface 16 and a second portion 26 carried on a side edge wall 28 of the dielectric member 18. The second portion 26 is disposed at a right angle to both the first portion 24 and the ground plane 20 and electrically interconnects the patch 14 with the ground plane 20 along one edge of the antenna 12.

Referring to FIG. 1, by way of example, although the second portion 26 of the patch 14 is illustrated as a solid vertical conducting wall, it can alternatively comprise an array of spaced apart conductive vias or through holes wherein adjacent vias/holes are spaced apart less than 1/20 of the shortest wavelength within the operational frequency band of the antenna 12. Restated, in an antenna having an operational frequency band of Fmin through Fmax, the maximum spacing (Smax) between any two adjacent vias/holes is ≤0.05 of the wavelength of Fmax.

Figure 3:
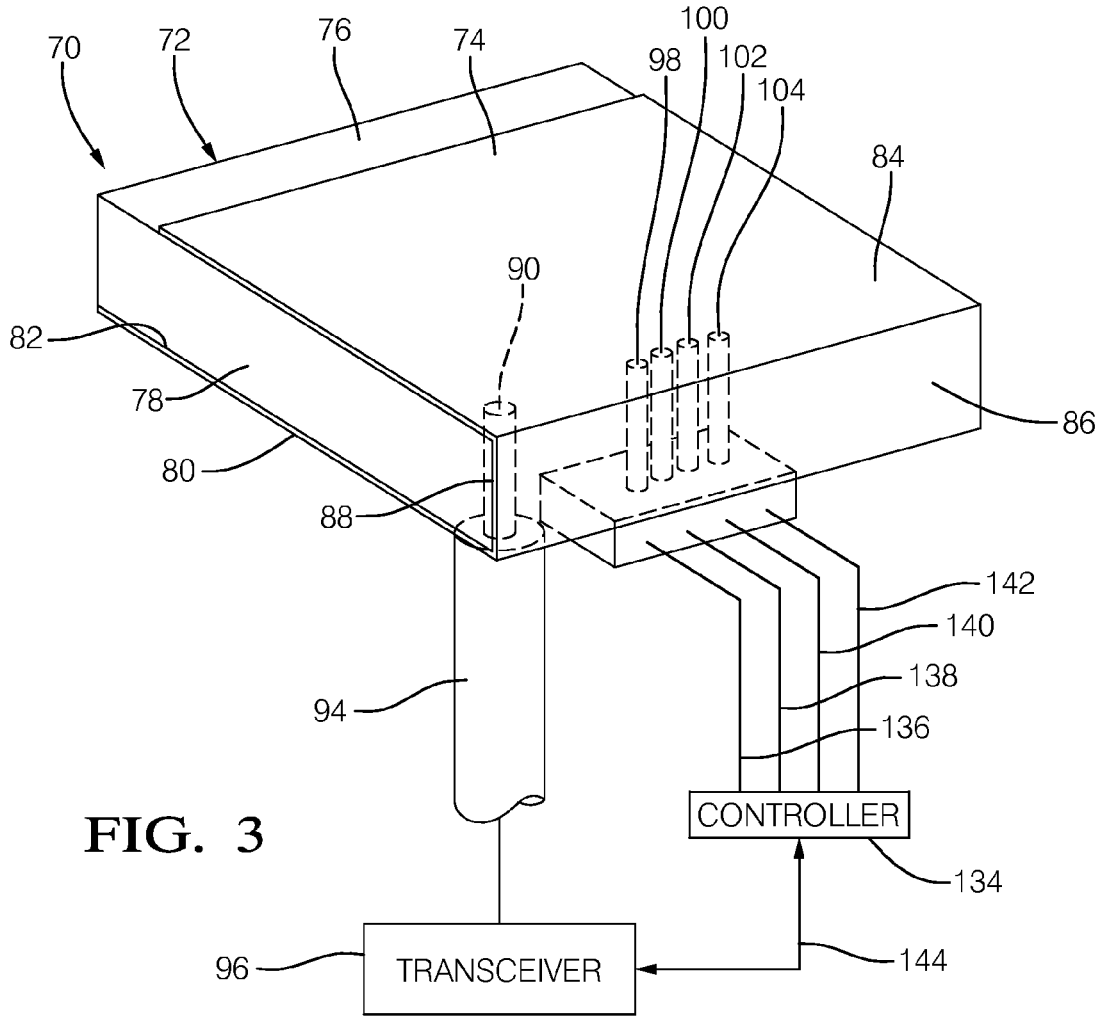
FIG. 3, is a schematic perspective illustration of an exemplary variable frequency half-patch antenna (second embodiment) embodying the present invention, configured for optimal operation in the 2.45-2.5 GHz band.

The antenna 12 has at least one vertical feed pin 30 electrically coupled to the patch 14 and extending downwardly through a passage 32 formed in the dielectric member 18, and exiting through an opening 36 formed in the ground plane 20 so as to be electrically isolated therefrom. A monolithic microwave integrated circuit (MMIC) package 34 is mounted to the underside of the ground plane 20 containing one or more GaAs single-pole, single-throw (SPST) type switches. The feed pin 30 extends through a passageway 36 in the MMIC package 34, and transitions into an RF isolated coaxial cable or feed 38 connected to a transmitter, receiver or transceiver circuit assembly such as illustrated in FIG. 3.

The antenna system 10 includes one or more vertical shorting pins 40 disposed in the dielectric member 18, each electrically coupled at their upper end to the patch 14 and extending downwardly into or through an associated registering opening 42 formed in the ground plane 20. Shorting pins 40 can be a solid cylindrical shape (as illustrated is the several embodiments of the invention depicted herein), a plated through bore, or the equivalent. The lowermost end or terminus of each shorting pin 40 forms a contact pad 44. The MMIC package 34 defines a separate active silicon area 46 associated with each shorting pin 40. Each active silicon area 46 has first and second switch contacts 48 and 50, respectively, formed on the upper surface 52 of the MMIC package 34. Each first switch contact 48 is positioned to register with the lower surface 54 of the ground plane 20 closely adjacent an associated opening 42. Each second switch contact 50 is positioned to register with the contact pad 44 of an associated shorting pin 40.

The MMIC package 34 is mechanically affixed to the patch antenna 12, the first switch contacts 48 are electrically interconnected to the ground plane 20, and the second switch contacts are electrically interconnected to associated contact pads 44, such as by use of solder balls 56 which have been reflowed to wet and engage their respective surface areas. Additional mechanical interconnection and establishment of additional electrical interconnection points can be established by the provision of supplemental contacts 58 joined by associated solder balls 60. For the sake of clarity, the solder balls 56 and 60 are illustrated in their initial and after reflow form.

Each active silicon area 46 and its associated first and second switch contacts 48 and 50 constitutes a switch 62, which is actuatable in response to an externally generated control signal between an open state wherein its associated shorting pin 40 is electrically isolated from the ground plane 20, and a closed state wherein its associated shorting pin 40 is electrically connected to the ground plane 20. As best illustrated in FIG. 2, edge terminals 64 permit interconnection of the patch antenna 12 with a control module (refer FIG. 3). Separately, an edge grounding terminal 66 provides direct earth or chassis grounding of the ground plane via a circuit trace 68.

Preferably, each contact pad 44 has a lower surface which is coplanar with the lower surface of the adjacent portion of the ground plane 20, and the switch contacts 48 and 50 have coplanar upper surfaces. This arrangement minimizes the impedance imposed by the grounding of the shorting pin 40 through the associated switch 62.

FIGS. 3, 4A, 4B and 5 depict the specifics of a simulated patch antenna system embodying the present invention consisting of a half-patch antenna excited with a vertical coaxial feed and containing multiple shorting pins on its aperture for impedance, frequency and pattern tuning. The particular dimensions, number of pins and the location of the feed shown in FIGS. 3, 4A, 4B and 5 are specific to an antenna operating in 2.45-2.5 GHz band and is intended to demonstrate the ability to auto-recover from detuning. The invention claimed here is a half-patch antenna manufactured on a substrate and containing a number of shorting pins throughout its aperture, which are switched to the ground plane by use of RF switches to provide tuning of antenna input impedance, frequency of operation and pattern.

The invention includes the manufacturing of the antenna as a surface mount component or as an embedded antenna integrated into a circuit board.

The fundamental structure is based on applicant's folded patch with variable shorting post topology, which we refer to as Self-Structuring Embedded Antenna (SSEA) and shown in FIGS. 3, 4A, 4B and 5. The substrate (RO6010) has a ground plane on the backside, an approximate quarter-wave patch on the front side, and a shorting strip on the side. The antenna is fed by a coaxial contact in one corner.

Figure 4B:
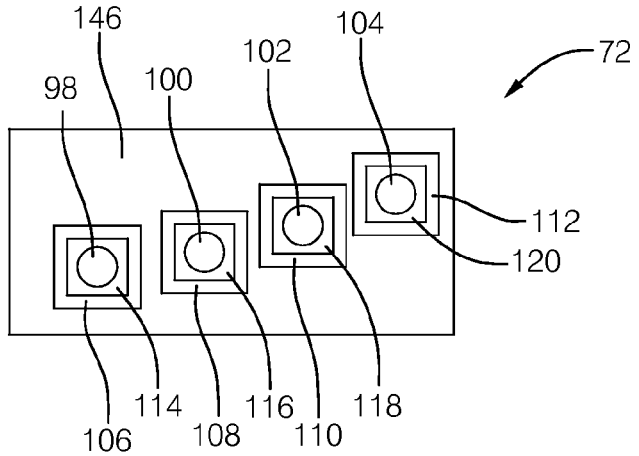
FIG. 4B, is a cut-away portion of the half-patch antenna ground plane of FIG. 4A, taken from the underside, on an enlarged scale, illustrating the details of the terminal islands or contact pads connected to the lower ends of respective shorting pins.
Figure 4A:
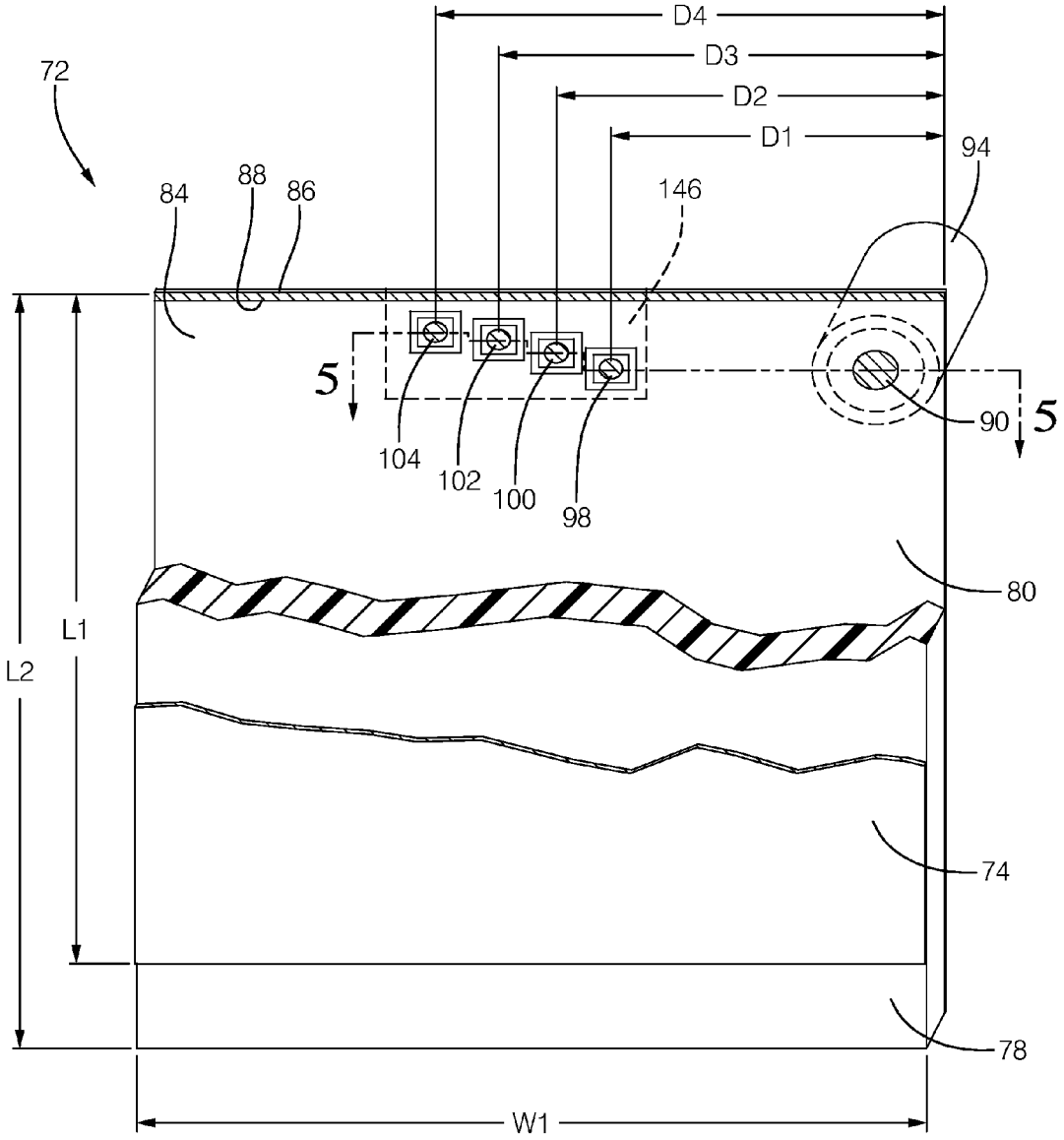
FIG. 4A, is a top view of the half-patch antenna of FIG. 3, with portions of the patch and dielectric cut away to expose a plurality of closely-nested shorting pins interconnecting grid locations of the patch to underlying terminal islands formed in the conductive ground plane overlaid by a single MMIC device.

In addition to the basic structure, there are four via holes from the top patch to the bottom of the substrate. These via holes are isolated from the ground plane by isolation rings. In practice, these via holes would be connected to the ground plane with single pole, single throw RF switches. This could be implemented with solid state FET based switches, MEMS switches, or even varactor diodes depending on the design. The example shown uses a simplistic approach of simply setting the on-state to 3 Ohms, and the off-state to 10 kOhms. This is implemented using a simulation model of an RLC boundary condition across a via pad to the ground plane on one side of the pad as shown in FIGS. 4A and 4B.

Figure 10:
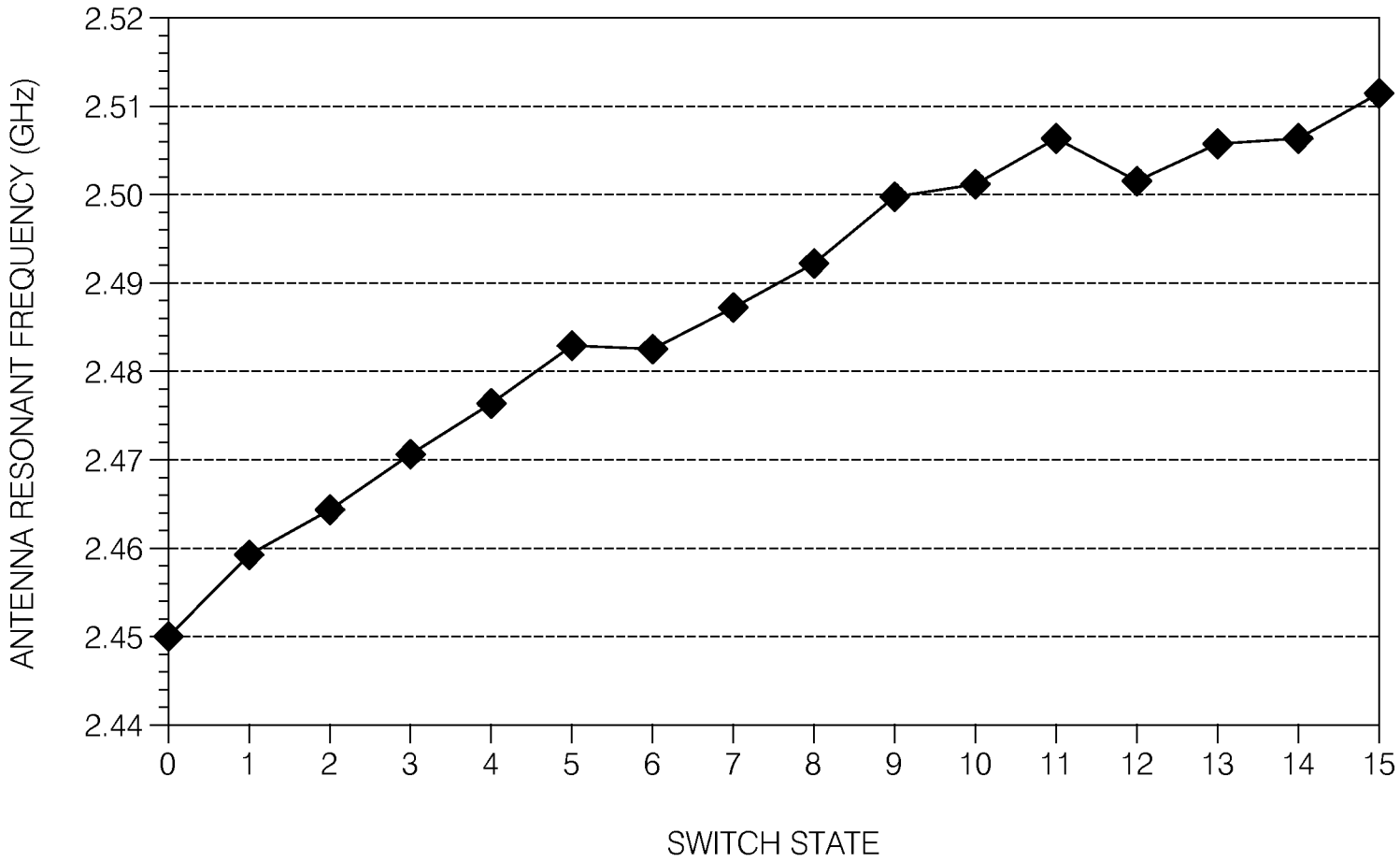
FIG. 10, is a graph of antenna natural resonant frequency vs. switch logic state of the embodiment of FIGS. 3, 4A, 4B and 5.
Figure 11:
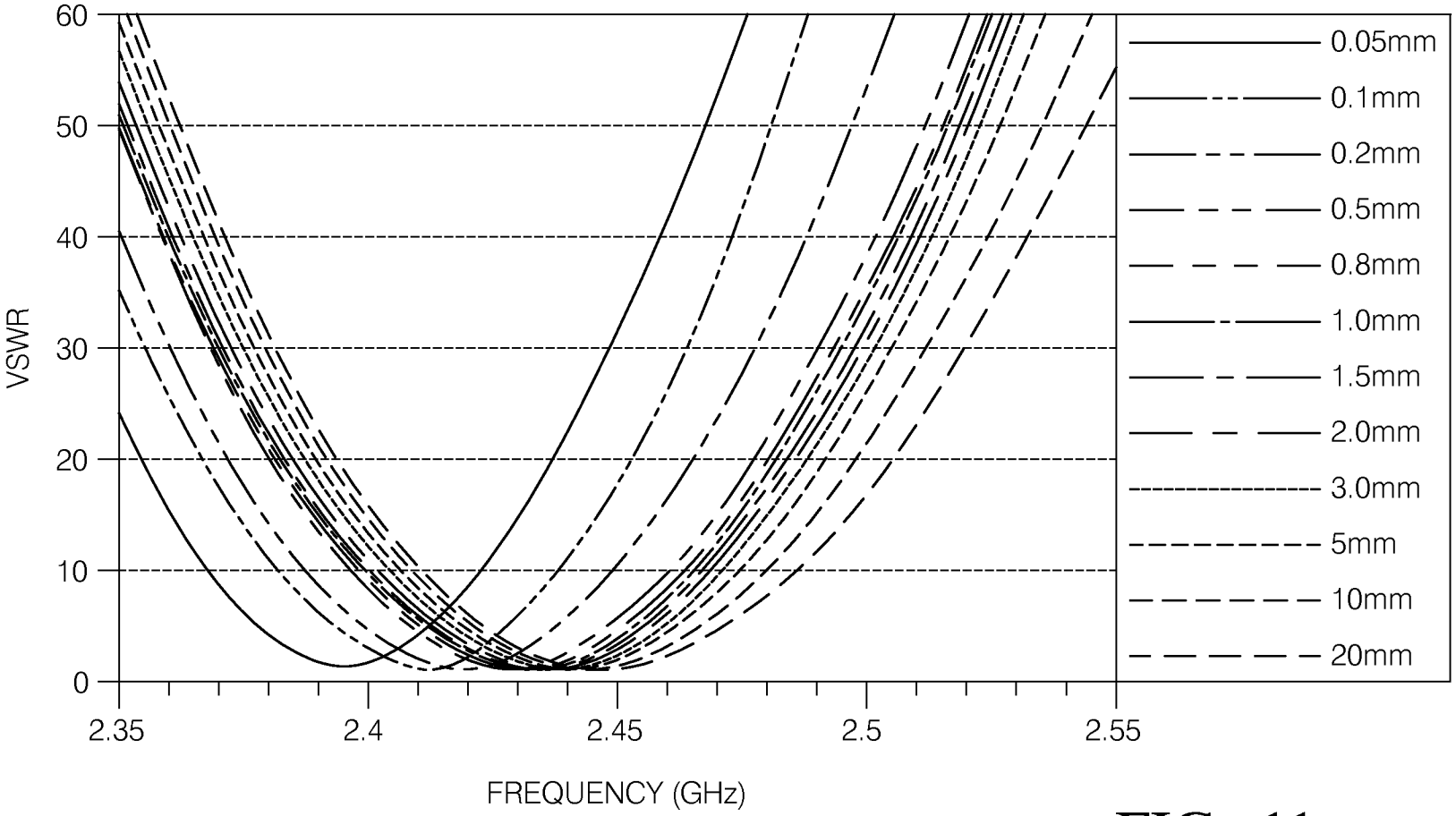
FIG. 11, is a graph of the voltage standing wave ratio (VSWR) for varying the distance between a large metallic block and the antenna from 0.05 to 20 mm (for the purpose of detuning the antenna). Above 20 mm, little detuning is observed and the resonant frequency asymptotically approaches 2.45 GHz. Note that the VSWR can degrade significantly for a relatively small change in resonant frequency.
Figure 12:
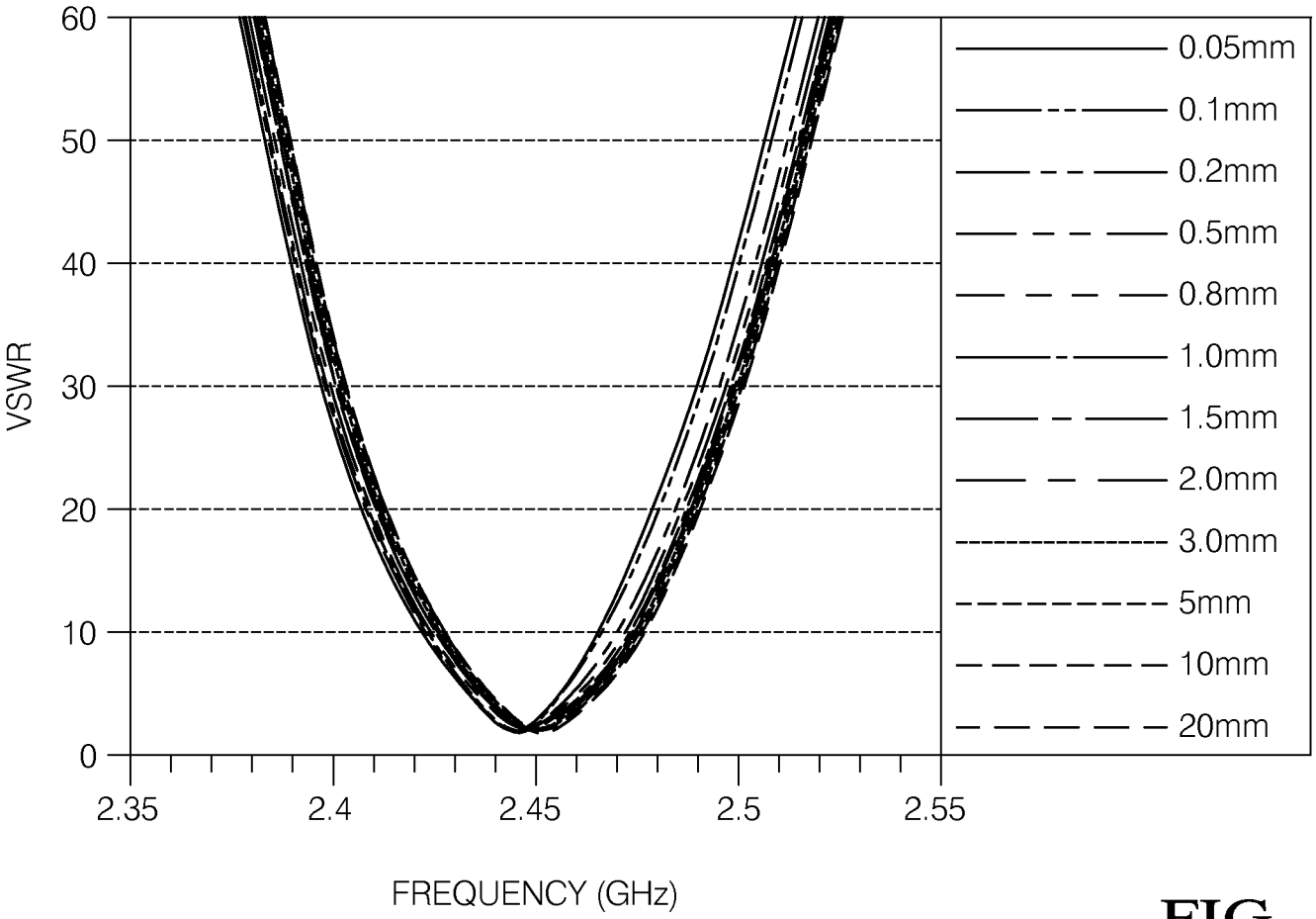
FIG. 12, is a graph of VSWR vs. metallic block distance to antenna board with compensation applied.

The via holes are located at strategic positions to allow for both frequency and impedance tuning of the antenna to achieve minimum return loss or VSWR. The locations were also picked to allow for an approximate linear shift in frequency vs. bit combination of the selected vias as shown in FIGS. 4*a* and 4B. For four vias, this equates to 16 states. State 0 would be setting the four bits to 0000 where bit 0 is the LSB, state 1 would be 0001 with only bit 0 asserted, etc. For the case where the antenna is isolated and is not interacting with an external object, the frequency increases with an increase in the bit index as shown in FIG. 10. It is important to note that the 4-bit configuration was selected to recover from a VSWR of as high as 30:1, which is a harsh condition and is only brought upon an object practically touching the antenna. Therefore, three pins (i.e., three bits) would have most likely sufficed to recover from a VSWR of 5:1, which is a more likely scenario.

The primary cause of antenna detuning while operating is due to a change of surrounding environment. This may include something as little as a hand holding a portable wireless device, a device placed on a metallic surface or mounted near a metal wall stud, water or salt spray getting on or into the device, or many other potential scenarios. For this study, a metal block is used to detune the antenna.

Figure 7:
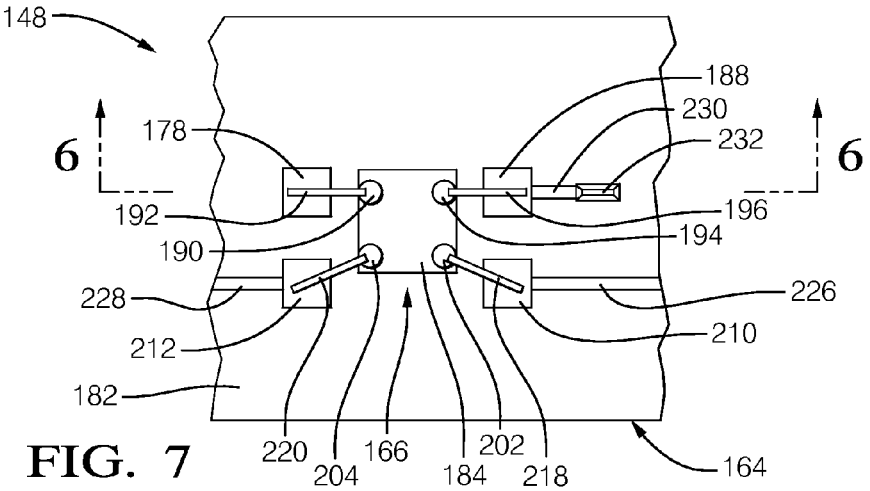
FIG. 7, is a bottom view, with the encapsulating bottom layer removed, of the patch antenna of FIG. 6, illustrating a "six pad" bare-die switch employed to selectively ground an associated shorting pin.

In a test conducted by the applicant, a metal block was moved about the open end of the antenna and the distance was varied from 0.05 mm to 20 mm to simulate various amounts of antenna detuning. The antenna's resonant frequency moves considerably with the movement of the metallic block, and since the antenna is resonant, so does the impedance at the desired frequency (2.45 GHz) as shown in FIG. 7, which shows the change in VSWR. Note that the metallic block tends to decrease the frequency of the antenna greatly degrading the impedance match at 2.45 GHz. Beyond the 20 mm distance between the block and the antenna, there is little interaction between them and therefore no detuning is observed. It should also be noted that the conductive patch does not extend to the end of the antenna board (substrate), but is pulled back slightly, and the distance of the block is referenced to the edge of the antenna board and not the conductive patch itself. A dielectric block was also tried with similar effect, but not as pronounced as the metallic block, which represents the worst case scenario.

Figure 8:
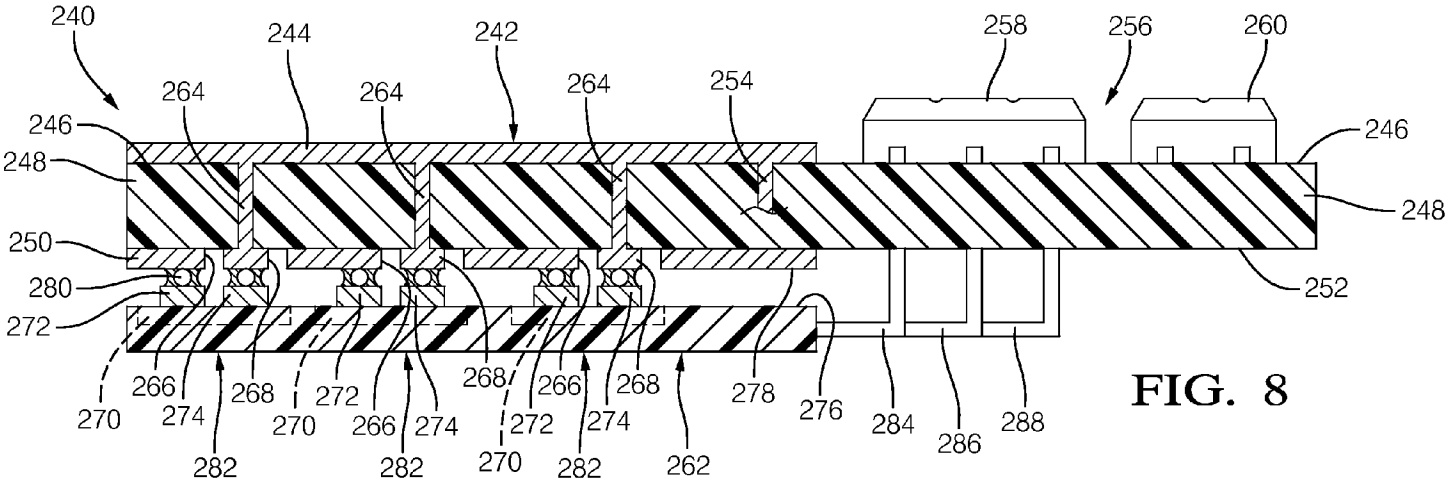
FIG. 8, is a cross-sectional view of a fourth embodiment of a patch antenna analogous to the embodiment of FIGS. 1 and 2 where the switches are implemented in an MMIC, wherein an antenna pattern or patch is embedded or printed on the top layer of a portion of a substrate such as a circuit board containing the antenna controller electronic circuitry and which is common with the transceiver circuitry of an associated wireless RF communication device such as a hand-held cell phone.

In the next step, for each detuning case, the bit combinations (switch logic states) were searched that would counteract the effect of the metal block for a range of 0.05 mm to 20 mm from the edge of the board. The resulting switch states adjust both frequency and input impedance of the antenna to bring the antenna back to tune again (at 2.45 GHz). FIG. 8 shows the VSWR of the retuned antenna and the complete data is tabulated in Table 1. Given the fact that the particular placement of the pins/switches in this study is only one solution out of many, it is entirely likely that other placements can be found to produce much lower power dissipation by the switches.

FIGS. 10-13 present exemplary simulation and empirical test data developed by the Applicant in a patch antenna system configured similarly to the embodiment illustrated and described herein pertaining particularly to FIGS. 3, 4A, 4B and 5. The data and operation described in connection with FIGS. 10-13, as well as any teaching evoked thereby, is understood to be part of the development process of the present invention and subject to interpretation by the inventor. Accordingly, FIGS. 10-13 are deemed to be exemplary and not limiting.

FIGS. 3, 4A, 4B and 5 depict a patch antenna system 70 comprising a patch antenna 72 including a conductive patch 74 mounted on the upper surface 76 of an insulating dielectric member 78, and a conductive ground plane 80 mounted on the lower surface 82 of the dielectric member 78. The ground plane 80 is, thus, spaced from and parallel to the portion of the patch 74 disposed on the upper surface 76 of the dielectric member 78. The antenna 72 is configured as a "half-patch" wherein the patch 74 includes a first portion 84 carried on the upper surface 76 and a second portion 86 carried on a side edge wall 88 of the dielectric member 78. The second portion 86 is disposed at a right angle to both the first portion 84 and the ground plane 80 and electrically interconnects the patch 74 with the ground plane 80 along one edge of antenna 72. Alternatively, the patch 74 can overlay the entire upper surface 76.

Figure 5:
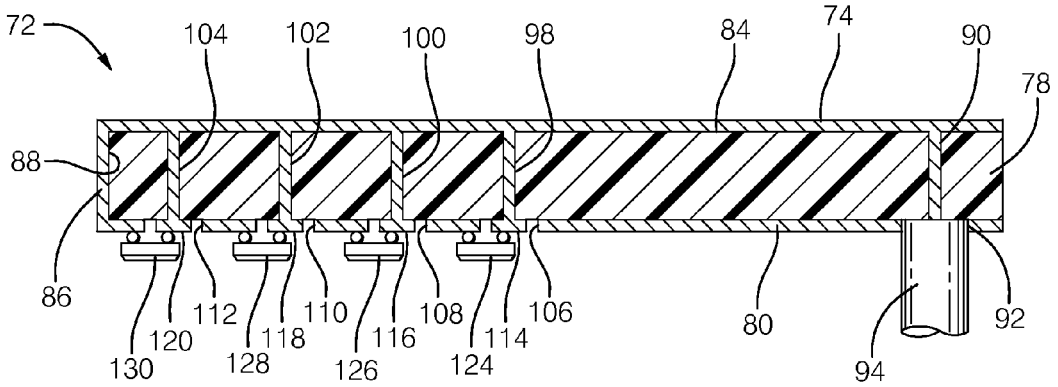
FIG. 5, is a cross-sectional view taken along line 5-5 of FIG. 4A illustrating internal detail of the half-patch antenna.

The antenna 72 has a vertical feed pin 90 electrically coupled to the patch 74 and extending downwardly through the dielectric member 78, and exiting through an opening 92 formed in the ground plane 80 so as to be electrically isolated therefrom. The feed pin 90 transitions into an RF isolated coaxial cable 94 connected to a transmitter, receiver or transceiver circuit assembly 96, as best illustrated in FIGS. 3 and 5.

The antenna system 70 includes four (4) vertical shorting pins 98, 100, 102 and 104, each disposed in the dielectric member 78, and each electrically coupled at its upper end to the patch 74 and extending downwardly through an associated registering opening 106, 108, 110 and 112, respectively, formed in the ground plane 80. The lowermost end or terminus of each shorting pin 98, 100, 102 and 104 forms a contact pad 114, 116, 118 and 120, respectively. Four discrete GaAs SPST type switches 124, 126, 128 and 130 are provided for selectively separately grounding the shorting pin contact pads 114, 116, 118 and 120 to the ground plane 80. Each switch 124, 126, 128 and 130 has first and second switch contacts formed on the upper surface of the switch facing the ground plane 80. Each first switch contact is positioned to register with the lower surface 54 of the ground plane 80 closely adjacent an associated opening 106, 108, 110 and 112. Each second switch contact is positioned to register with the contact pad 114, 116, 118 and 120 of an associated shorting pin 98, 100, 102 and 104. Each switch 124, 126, 128 and 130 is electrically and mechanically affixed by weldments employing solder balls such as described in connection with the embodiment of FIGS. 1 and 2.

Each switch 124, 126, 128 and 130 is connected to a controller circuit 134 through a separate signal feed line 136, 138, 140 and 142, respectively, and actuatable in response to an externally generated control signal between an open state wherein its associated shorting pin 98, 100, 102 and 104, respectively, is electrically isolated from the ground plane 80, and a closed state wherein its associated shorting pin 98, 100, 102 and 104, respectively, is electrically connected to the ground plane 80. The controller circuit 134 is interconnected with the transmitter/receiver device 96 by a bidirectional control bus 144. The switches 124, 126, 128 and 130 in the present embodiment are packaged CMOS RF switches such as those sold by Hittite Microwave Corporation as model HMC 550. The dielectric member 78 is preferably a Rogers Laminate such as RO3010 or RO6010.

As best seen in FIGS. 4A and 4B, the shorting pins 98, 100, 102 and 104 are precisely arranged in a predetermined pattern encompassed by a fixed surface region 146 of the patch 74. Note that FIG. 4A depicts the shorting pins 98, 100, 102 and 104 as viewed from above with overlaying portions of the patch 74 and the dielectric member 78 cut away. FIG. 4B depicts the same shorting pins 98, 100, 102 and 104 as viewed from below with the switches 124, 126, 128 and 130 removed. In the embodiment illustrated in FIGS. 3, 4A, 4B and 5, it is believed that less than 10% of the entire surface area of the patch 74 is enveloped by the fixed surface region 146. This, of course, will change with differing frequency band requirements.

FIGS. 1, 2, 5 and 6 show two options for manufacturing the antenna as a surface mount component. As an example only, the conductive patch 74 has a lateral width dimension W1 of 10 mm and a longitudinal length dimension L1 of 9.5 mm. The dielectric member 78 and ground plane 80 have a width dimension W1 of 10 mm and an overall length dimension L2 of 11 mm. The feed pin 90 is positioned adjacent the upper right-hand corner of the patch antenna 92, closely spaced from the second portion 86 of the conductive patch 74. Switch 124 is laterally spaced a distance D1 of 4.3 mm from the corner of the patch antenna 92 harboring the feed pin 90. Switch 126 is laterally spaced a distance D2 of 5.0 mm from the corner. Switch 128 is laterally spaced a distance D3 of 5.7 mm from the corner. Lastly, switch 130 is laterally spaced a distance D4 of 6.5 mm from the corner. Each feed pin has a nominal diameter of 0.3 m.m., each via pad is square @ 0.4 m.m. per side, and the via ground plane openings are each square @ 0.6 m.m. per side. In the configuration considered by the applicant, the switch parasitics are approximated by an RLC boundary condition, with switch "on-state" approximated as 3 Ohms and switch "off-state" approximated with 10 kOhms Clearly, the present invention significantly reduces the dimensional requirements for patch type antennas operating in this band.

Figure 6:
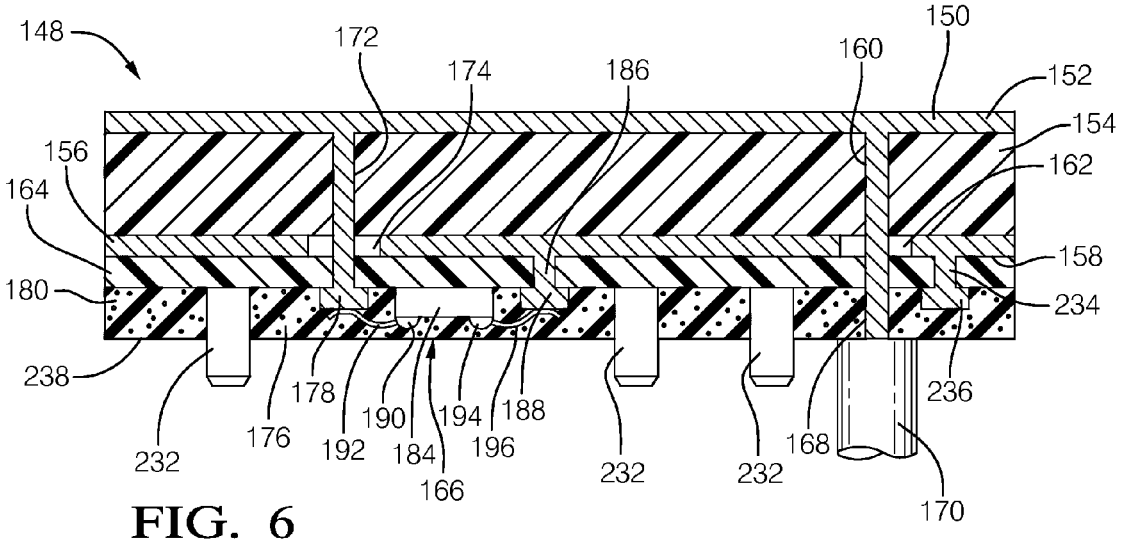
FIG. 6, is a cross-sectional view of a third embodiment of a patch antenna, taken on lines 6-6 of FIG. 7, packaged as a surface mount component containing multiple shorting pins configured for selective shorting to an antenna ground plane by discrete packaged or bare-die RF switches.

FIGS. 6 and 7 depict an embodiment where bare-die RF switches are surface-mounted onto the antenna printed circuit board. Packaged switches are simply soldered in place while bare-die switches need to have a passive surface of the die affixed to the PCB and have its separate contacts each wire-bonded and will require a non-conducting epoxy (making up the bottom layer) to secure the wire-bonds. Though packaged switches are easier to mount, bare-die switches are much smaller in size and therefore offer higher RF performance. The antenna is printed on the top layer which also includes plating extending through via holes that represent the shorting pins. The middle layer contains the switch bias and control network, and provides electrical connection between the switches and the shorting pins to achieve the switching action for shorting and not shorting the pins to the ground. Top and the middle substrate layers are manufactured together by standard circuit board manufacturing process and are separated by a ground plane, which also contains blind-vias. The switches are mounted through a standard circuit assembly process (pick and place machines and reflow for packaged switches and automatic wire-bonding machines for the bare-dies).

FIGS. 6 and 7 depict a third embodiment of the present invention comprising a patch antenna 148 including a conductive patch 150 mounted on the upper surface 152 of an insulating dielectric member 154, and a conductive ground plane 156 mounted on the lower surface 158 of the dielectric member 154. The ground plane 156 is, thus, spaced from and parallel to the conductive patch 150. The antenna 148 is configured as a traditional patch.

The antenna 148 has at least one vertical feed pin 160 electrically coupled to the patch 150 and extending downwardly through the dielectric member 154, and exiting through an opening 162 formed in the ground plane 156 so as to be electrically isolated therefrom. A printed circuit board (PCB) 164 is mounted to the underside of the ground plane 156 containing one or more GaAs SPST bare-die type switches 166 (only 1 is illustrated). The feed pin 160 extends through a passageway 168 in the PCB 164, and transitions into an RF isolated coaxial cable 170 connected to a transmitter, receiver or transceiver circuit assembly such as illustrated in FIG. 3.

The antenna 148 includes one or more vertical shorting pins 172 disposed in the dielectric member 154, each electrically coupled at its upper end to the patch 150 and extending downwardly through an associated registering opening 174 formed in the ground plane 156 and a concentric via 176 in the PCB 164. The lowermost end or terminus of each shorting pin 172 forms a contact pad 178 on the lower surface 180 of the PCB 164. Each switch 166 has a non-active surface of its die 184 insulatingly adhered to the lower surface 180 of the PCB 164. Additional vias 186 formed in the PCB 164 establish a conductive ground path from the ground plane 156, through the PCB 164 and terminating in a contact pad 188 disposed on the lower surface 180 of the PCB 164. The contact pads 178 and 188 associated with a given switch 166 are closely spaced apart to straddle the associated switch die 184. Each switch die 184 has a passive surface adhesively affixed to the lower surface 180 of the PCB 164 and an opposed active surface (facing downwardly in FIG. 6). Each switch die 184 has a first switch contact 190 connected to the contact pad 178 of an associated shorting pin 172 by a wire-bond 192. Each switch die 184 also has a second switch contact 194 connected to the contact pad 188 of an associated grounding via 186 by a wire-bond 196. Typically, wire-bonds comprise a conductive wire soldered at one end to the associated semiconductor device die and welded at the opposed end to a contact pad formed by a shorting pin, a lead frame, or the like. As an example, in FIGS. 6 and 7, one end of wire-bond 192 is re-flow soldered to a solder micro-bump (first switch contact) 190 formed in one corner of the die 184. The opposed end of wire-bond 192 is welded to contact pad 178. This ensures minimal resistance and impedance in the electrical interconnection between the die micro-contact and its associated contact pad.

As best viewed in FIG. 7, switch die 184 is a "four pad" device forming additional input/output contacts 202 and 204 which are connected to associated contact pads 210 and 212 by wire bonds 218 and 220, respectively. Contacts 190, 194, 202 and 204 are solder micro-bumps formed on the active surface of the switch die 184. Contact pads 210 and 212 are interconnected to conditioning or control circuitry (not illustrated) carried on the lower surface 180 of the PCB 164 by conductive traces 226 and 228, respectively. The conductive traces 228 and 230 are dressed on the lower surface 182 of the PCB 164 to connect with other conductive traces, surface mount components or semiconductor devices, or externally accessible connectors, such as spade terminals 232 which, in application, would be connected to a controller, as depicted in FIG. 3. If required, additional vias 234 can be formed in the PCB 164 extending between the ground plane 156 and contact pads 236 on the lower surface 180 of the PCB 164. The switch 166, as well as the electrical components carried on the lower surface 180 of the PCB 164, are electrically insulated and protectively encased with an encapsulating layer 238 of non-conducting epoxy or the like. Alternatively, analogous "six pad" devices can be employed in implementing the present invention.

FIGS. 1 and 2 show the case where, in reference to FIGS. 6 and 7, the middle substrate layer and the surface mount switches are combined into a Monolithic Microwave Integrated Circuit (MMIC) which is soldered to the top antenna layer board via solder balls (or flip-chip process). While packaging is easier in this case, the cost of MMIC will increase the Bill of Materials (BOM) cost. Though it may be more expensive to manufacture, the MMIC option will deliver higher RF performance due to drastic reduction on parasitics typically associated with packaged switches and wire-bonds.

Figure 9:
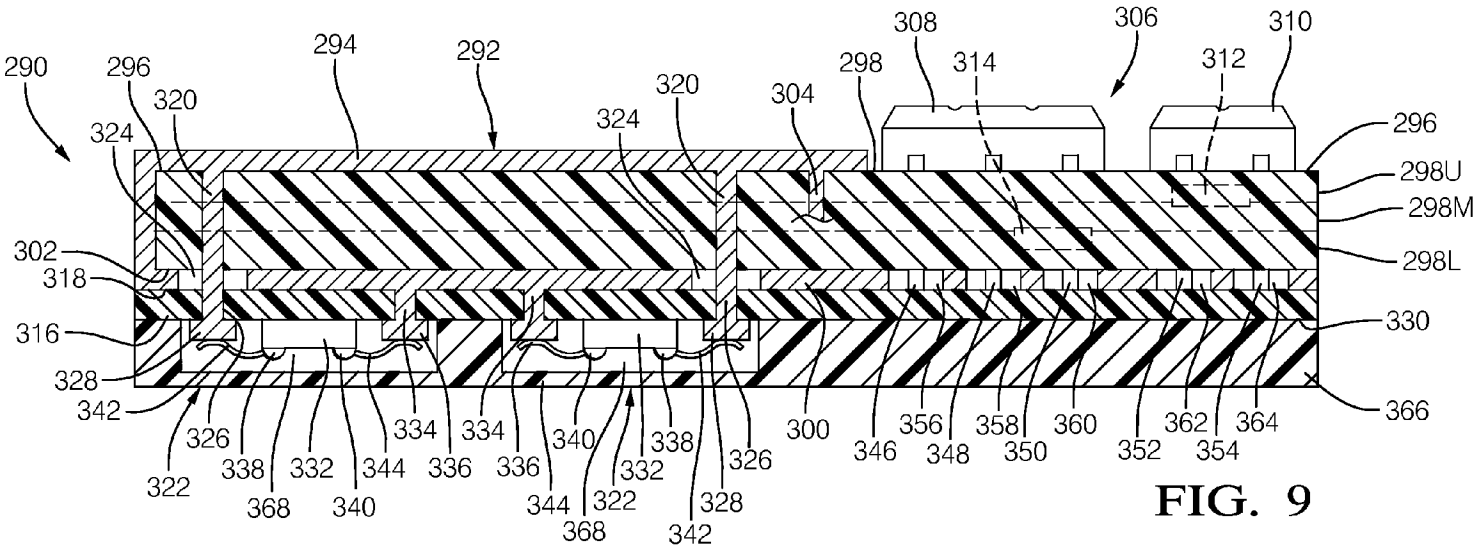
FIG. 9, is a cross-sectional view of a fifth embodiment of a patch antenna analogous to the embodiment of FIGS. 5 and 6 where the discrete switches are mounted on the bottom layer of a substrate such as a multi-layer circuit board containing antenna controller electronic circuitry, and wherein an antenna pattern or patch is embedded or printed on the top layer of a portion of the multi-layer circuit board which is common with the transceiver circuitry of an associated wireless RF communication device such as a hand-held cell phone.

Depending on the application (especially when more space is available for the antenna on the circuit board), it may advantageous to implement the antenna as part of the circuit board (which also houses the rest of the electronics) than having it mounted as a surface mount component. Embedding of the antenna into the circuit board is the less expensive option in terms of antenna (avoiding the packaging cost) but complicates further the design and packaging of the circuit board so in a sense shifts the cost from the antenna to the circuit board. However, the embedded option may have better RF performance due to fewer and better RF transitions in antenna feed network in addition to having a larger antenna, which also results in better performance. FIGS. 8 and 9 show two options for embedding the antenna into a circuit board. In both cases, the antenna is implemented in the top substrate layer but the difference is in how the switching of the pins is accomplished.

The embodiment of FIG. 9 is analogous to the embodiment of FIGS. 6 and 7 where the switches are again mounted on the bottom side of the middle layer except that the concept of middle layer here may difference since the circuit board itself may have multiple layers and what is referred to as middle layer in the embodiment of FIGS. 5 and 6 could be the bottom layer of the circuit board here. If bare-dies are used, one may need to coat the bottom side with a non-conducing epoxy for securing the wire-bonds.

Similarly the embodiment of FIG. 8 is analogous to the embodiment of FIGS. 1 and 2 where the middle layer and the switches are now implemented in an MMIC, which is mounted to the bottom side of the antenna board via solder balls (or flip-chip process). As opposed to FIG. 3(*a*), there is no need for an encapsulation later, however, the mounting of the MMIC component needs to be via flip-chip (not soldering of the packaged version) in order not to undo the benefits of the RF performance provided by the MMIC. Though, as in, FIG. 2(*b*), the BOM cost is higher due to MMIC, the RF performance here is the highest.

FIGS. 8 and 9 depict implementations of the present invention in applications where space is available to incorporate an antenna in or on the printed circuit board of a host electronic apparatus. One contemplated application is hand-held personal communication devices, such as cellular telephones, and the like, and will be described in that context. The device of FIG. 8 is similar in a number of respects to the embodiment of FIGS. 1 and 2. The device of FIG. 9 is similar in a number of respects to the embodiment of FIGS. 6 and 7.

FIG. 8 depicts an RF communication device 240 comprising a patch antenna 242 including a conductive patch 244 mounted on the upper surface 246 of a portion of a substrate or printed circuit board 248 functioning, inter alia, as an insulating dielectric member. A conductive ground plane 250 is mounted on the lower surface 252 of the PCB dielectric member 248. The ground plane 250 is, thus, spaced from and parallel to the conductive patch disposed 244 on the upper surface 246 of the PCB dielectric member 248.

The antenna 242 has at least one vertical feed pin 254 electrically coupled to the patch 244 and extending downwardly into the PCB dielectric member 248 and interfaced with device communication circuitry 256 carried on other portions of the PCB 248. The circuitry 256 can consist of surface mount components and microprocessor based devices such as an RF front end module 258 and a broad band processor 260. A monolithic microwave integrated circuit (MMIC) package 262 is mounted to the underside of the ground plane 250 containing one or more GaAs SPST type switches.

The antenna 242 includes one or more vertical shorting pins 264 disposed in the dielectric member 248, each electrically coupled at their upper end to the patch 244 and extending downwardly into or through an associated registering opening 266 formed in the ground plane 250. The lowermost end or terminus of each shorting pin 264 forms a contact pad 266. The MMIC package 262 defines a separate active silicon area 270 associated with each shorting pin 264. Each active silicon area 270 has first and second switch contacts 272 and 274, respectively, formed on the upper surface 276 of the MMIC package 262. Each first switch contact 272 is positioned to register with the lower surface 278 of the ground plane 250 closely adjacent an associated opening 266. Each second switch contact 274 is positioned to register with the contact pad 268 of an associated shorting pin 264.

The MMIC package 262 is mechanically affixed to the patch antenna 242, the first switch contacts 272 are electrically interconnected to the ground plane 250, and the second switch contacts 274 are electrically interconnected to associated contact pads 268, such as by use of solder balls 280 which have been reflowed to wet and engage their respective surface areas.

Each active silicon area 270 and its associated first and second switch contacts 272 and 274 constitutes a switch 282, which is actuatable in response to an externally generated control signal between an open state wherein its associated shorting pin 264 is electrically isolated from the ground plane 250, and a closed state wherein its associated shorting pin 264 is electrically connected to the ground plane 250. D.C. interconnects 284, 286 and 288 permit interconnection of the patch antenna 242 with a control circuitry 256.

FIG. 9 depicts an RF communication device 290 comprising a patch antenna 292 including a conductive patch 294 mounted on the upper surface 296 of a portion of a multi-layer substrate or printed circuit board 298 functioning, inter alia, as an insulating dielectric member. A conductive ground plane 300 is mounted on the lower surface 302 of the PCB dielectric member 298. The ground plane 300 is, thus, spaced from and parallel to the conductive patch disposed 294 on the upper surface 296 of the PCB dielectric member 298.

The antenna 292 has at least one vertical feed pin 304 electrically coupled to the patch 294 and extending downwardly into the PCB dielectric member 298 and interfaced with device communication circuitry 306 carried on other portions of the PCB structure 298. The circuitry 306 can consist of surface mount components and microprocessor based devices such as an RF front end module 308 and a broad band processor 310. The PCB 298 can comprise multiple stacked PCBs illustrated, by way of example, as consisting an upper PCB 298U, a middle PCB 298M and a lower PCB 298L. In addition to surface mount devices carried on the upper surface 296, additional devices and conductive circuit traces can be embedded at intermediate locations of the PCB stack consisting of 298U, 298M and 298L such as a device 312 nested in recesses between PCBs 298U and 298M, and device 314 nested in recesses between PCBs 298M and 298L.

FIG. 9 depicts a fifth embodiment where RF switches are surface-mounted onto a separate PCB 316 mounted to the lower surface 318 of the ground plane 300. Packaged switches are simply soldered while bare-die switches (illustrated) need to be wire-bonded and will require a non-conducting epoxy (making up the bottom layer) to secure the wire-bonds. Though packaged switches are easier to mount, bare-die switches are much smaller in size and therefore offer higher RF performance. The patch 294 is printed on the top layer 296 which also includes plating extending through registering via holes extending through PCBs 298U, 298M and 298L, that form shorting pins 320. The PCB 316 contains the switch bias and control network, and provides electrical connection between the switches and the shorting pins 320 to achieve the switching action for shorting and not shorting the pins to the ground. Substrate layers 298 and 316 are manufactured together by standard circuit board manufacturing process and are separated by the ground plane 300, which also contains blind-vias. The switches are mounted through a standard circuit assembly process (pick and place machines and reflow for packaged switches and automatic wire-bonding machines for the bare-dies).

The printed circuit board (PCB) 316 mounted to the underside of the ground plane 300 contains one or more GaAs SPST bare-die type switches 322 (only 2 are illustrated) in a manner similar to that described in connection with FIGS. 6 and 7 herein above. Only the switch contacts of the bare-die switches 332, and their interconnection to 328 and 336 via wire bond 342 and 344, respectively, are illustrated in FIG. 9. I/O contacts of switches 322 and their interconnection to associated contact pads carried on the lower surface of the PCB 316 via wire-bonds are not illustrated in FIG. 9 for the sake of avoiding duplication.

The antenna 292 includes one or more vertical shorting pins 320 disposed in the dielectric member 298, each electrically coupled at its upper end to the patch 294 and extending downwardly through an associated registering opening 324 formed in the ground plane 300 and a concentric via 326 in the PCB 316. The lowermost end or terminus of each shorting pin 320 forms a contact pad 328 on the lower surface 330 of the PCB 316. Each switch 322 has a non-active surface of its die 332 insulatingly adhered to the lower surface 330 of the PCB 316. Additional vias 334 formed in the PCB 316 establish a conductive ground path from the ground plane 300, through the PCB 316 and terminating in a contact pad 336 disposed on the lower surface 330 of the PCB 316. The contact pads 328 and 336 associated with a given switch 322 are closely spaced apart to straddle the associated switch die 332. Each switch die 332 has a first switch contact 338 connected to the contact pad 328 of an associated shorting pin 320 by a wire-bond 342. Each switch 332 also has a second switch contact 340 connected to the contact pad 336 of an associated grounding via 334 by a wire-bond 344.

The switches 322 described in connection with the embodiment of FIG. 9 function similarly to the switches described in connection with FIGS. 6 and 7.

A number of D.C. interconnections 346, 348, 250, 352 and 354 extend between the circuitry of PCB 316 and PCB 298 through insulating passageways 356, 358, 360, 362 and 364. A cover or layer 366 formed of insulating material overlays the lower surface 330 of the PCB 316, forming protective pockets 368 enclosing respective switches 322. Alternatively, layer 366 can be replaced with an epoxy ball dropped on the wire bonds to secure them in their illustrated positions.

FIGS. 14 and 15, depict a patch antenna system 370 comprising a patch antenna 372 including a conductive patch 374 mounted on the upper surface 376 of an insulating dielectric member 378, and a conductive ground plane 380 mounted on the lower surface 382 of the dielectric member 378. The ground plane 380 is, thus, spaced from and parallel to the portion of the patch 374 disposed on the upper surface 376 of the dielectric member 378. The antenna 372 is configured as a "half-patch" wherein the patch 374 includes a first portion 384 carried on the upper surface 376 and a second portion 386 carried on a side edge wall 388 of the dielectric member 378. The second portion 386 is disposed at a right angle to both the first portion 384 and the ground plane 380 and electrically interconnects the patch 374 with the ground plane 380 along one edge of antenna 372. Alternatively, the patch 374 can overlay the entire upper surface 376.

The antenna 372 has a vertical feed pin (not illustrated) similar to that depicted in connection with FIG. 6. The antenna system 370 includes a plurality of vertical shorting pins 390 (only one is illustrated), each disposed in the dielectric member 378, and each electrically coupled at its upper end to the patch 374 and extending downwardly through an associated registering opening 392, respectively, formed in the ground plane 380. The lowermost end or terminus of each shorting pin 390 forms a contact pad 394. A discrete GaAs SPST bare-die type switch 396 is provided for selectively separately grounding the shorting pin contact pad 394 to the ground plane 380. The switch 396 has a bare-die 398 with a passive surface 400 adhesively bonded to the exposed lower surface 402 of the ground plane 380, and an opposed active surface 404 facing away from the lower surface 402 of the ground plane 380. A PCB 406 is adhesively bonded to the exposed lower surface 402 of the ground plane 380 adjacent each switch 396.

The active surface 404 of each switch die 398 forms a first switch contact 408 interconnected to the associated contact pad 394 by a wire-bond 410 and a second switch contact 412 interconnected to the ground plane 380 by a wire-bond 414. The active surface 404 of each switch die 398 also forms a first i/o contact 416 interconnected to an associated first PCB contact 418 by a wire-bond 420 and a second i/o contact 422 interconnected to an associated second PCB contact by a wire-bond 426. Contacts 418 and 424 are interconnected to conditioning or control circuitry (not illustrated) carried on the lower surface 428 of the PCB 406 by conductive traces 430 and 432, respectively. The conductive traces 430 and 430 are dressed on the lower surface 428 of the PCB 406 to connect with other conductive traces, surface mount components or semiconductor devices, or externally accessible connectors, such as spade terminals 232 which, in application, would be connected to a controller, as depicted in FIG. 3. The switch 396, as well as the electrical components carried on the lower surface 428 of the PCB 406, are electrically insulated and protectively encased with an encapsulating layer 434 of non-conducting epoxy or the like.

Figure 16:
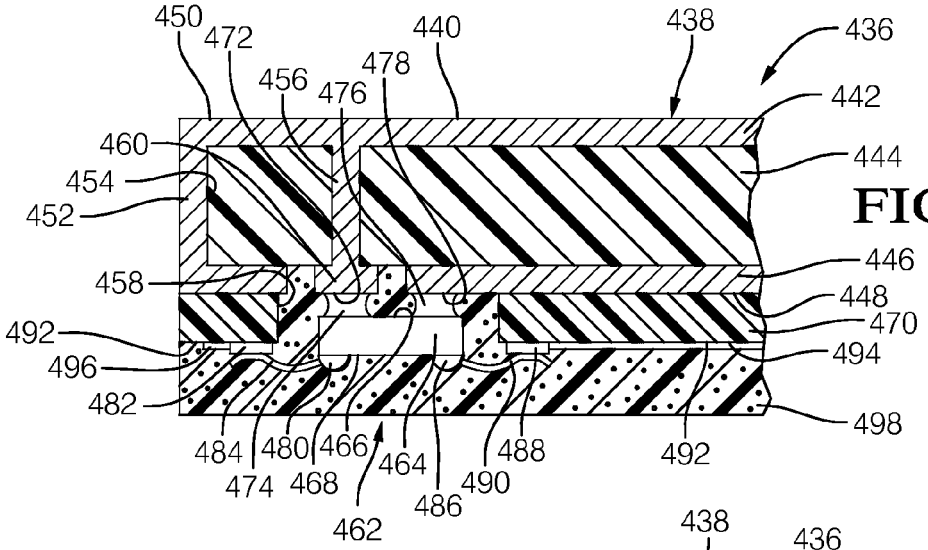
FIG. 16, is a broken, cross-sectional view of a seventh embodiment of a patch antenna, wherein a switch die with two active surfaces (with micro bump RF switch contacts disposed on one surface and micro bump i/o contacts disposed on a separate, opposite surface), with the RF switch contacts directly solder bonded to the associated patch antenna shorting pin contact pad and ground plane, and the i/o contacts wire-bonded to associated control circuit PCB contact pads.
Figure 17:
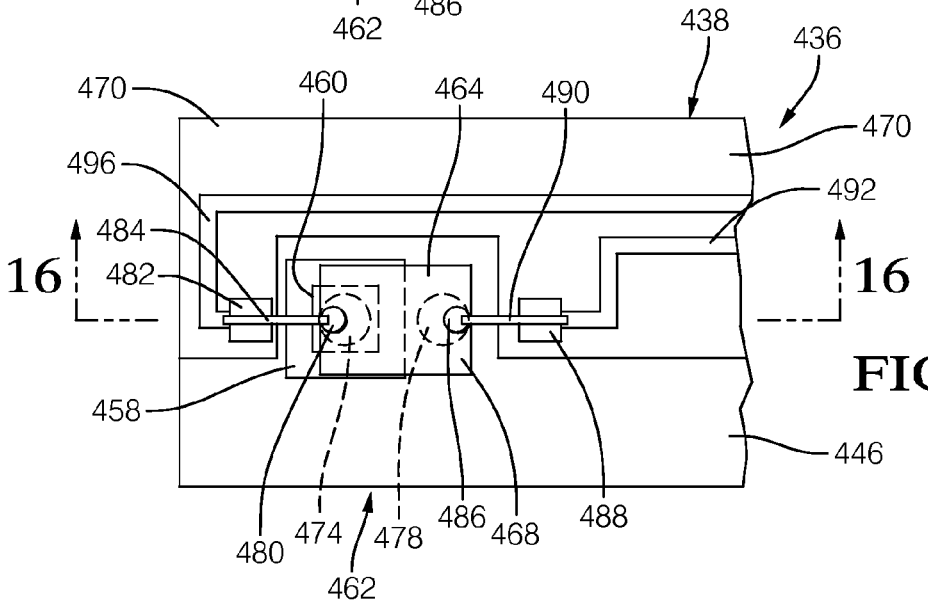
FIG. 17, is a broken bottom view of the patch antenna of FIG. 16 illustrating wire-bonding of the DC control contacts to adjacent PCB contact pads as well as (in phantom) direct solder bonding of the switch RF contacts to associated patch antenna shorting pin contact pad and ground plane.

FIGS. 16 and 17, depict a patch antenna system 436 comprising a patch antenna 438 including a conductive patch 440 mounted on the upper surface 442 of an insulating dielectric member 444, and a conductive ground plane 446 mounted on the lower surface 448 of the dielectric member 444. The ground plane 446 is, thus, spaced from and parallel to the portion of the patch 440 disposed on the upper surface 442 of the dielectric member 444. The antenna 438 is configured as a "half-patch" wherein the patch 440 includes a first portion 450 carried on the upper surface 442 and a second portion 452 carried on a side edge wall 454 of the dielectric member 444. The second portion 452 is disposed at a right angle to both the first portion 450 and the ground plane 446 and electrically interconnects the patch 440 with the ground plane 446 along one edge of antenna 454. Alternatively, the patch 440 can overlay the entire upper surface 442.

The antenna 438 has a vertical feed pin (not illustrated) similar to that depicted in connection with FIG. 6. The antenna system 436 includes a plurality of vertical shorting pins 456 (only one is illustrated), each disposed in the dielectric member 444, and each electrically coupled at its upper end to the patch 440 and extending downwardly through an associated registering opening 458, respectively, formed in the ground plane 446. The lowermost end or terminus of each shorting pin 456 forms a contact pad 458. A discrete GaAs SPST bare-die type switch 462 is provided for selectively separately grounding the shorting pin contact pad 460 to the ground plane 446. The switch 462 has a bare-die 464 with a first active surface 466 facing the ground plane 446 and an opposed second active surface 468 facing away from the ground plane 446. A PCB 470 is adhesively bonded to the exposed lower surface 448 of the ground plane 446 adjacent each switch 462.

The first active surface 466 of each switch die 464 forms a first switch contact 472 interconnected to the associated contact pad 460 by a solder weldment such as a solder ball 474 and a second switch contact 476 interconnected to the ground plane 446 by a second weldment or solder ball 478. The second active surface 468 of each switch die 464 also forms a first i/o contact 480 interconnected to an associated first PBC contact 482 by a wire-bond 484 and a second i/o contact 486 interconnected to an associated second PBC contact 488 by a wire-bond 490. Contacts 482 and 488 are interconnected to conditioning or control circuitry (not illustrated) carried on the lower surface 492 of the PCB 470 by conductive traces 494 and 496, respectively. The conductive traces 494 and 496 are dressed on the lower surface 492 of the PCB 470 to connect with other conductive traces, surface mount components or semiconductor devices, or externally accessible connectors, such as spade terminals 232 which, in application, would be connected to a controller, as depicted in FIG. 3. The switch 462, as well as the electrical components carried on the lower surface 492 of the PCB 470, are electrically insulated and protectively encased with an encapsulating layer 498 of non-conducting epoxy or the like.

Figure 18:
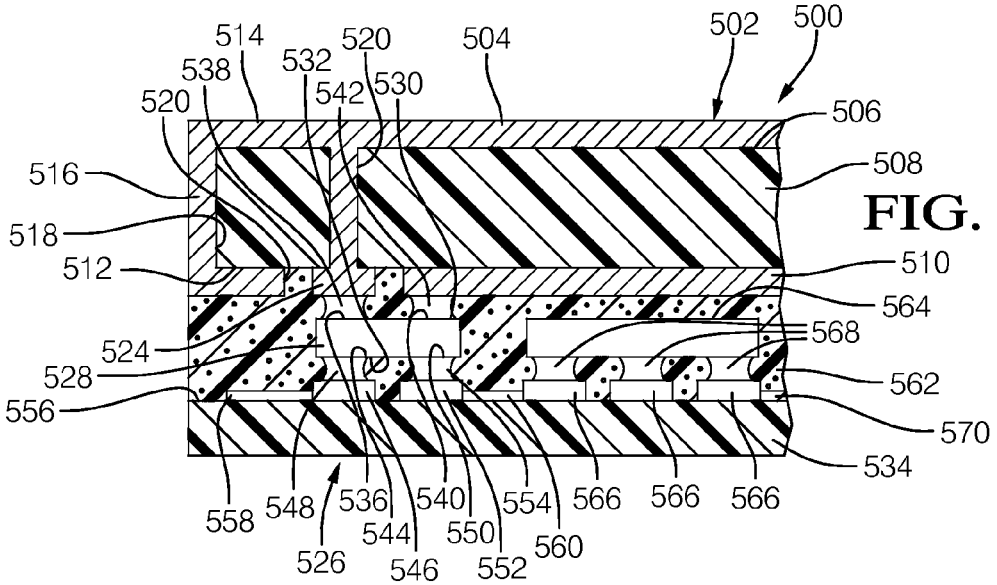
FIG. 18, is a broken, cross-sectional view of a eighth embodiment of a patch antenna, similar in some respects to the embodiment of FIG. 16, but wherein a switch die with two active surfaces (with micro bump switch contacts disposed on one surface and micro bump i/o contacts disposed on a separate, opposite surface), with the switch contacts directly solder bonded to the associated patch antenna shorting pin contact pad and ground plane, and the i/o contacts directly solder bonded to associated control circuit PCB contact pads.

FIG. 18, depicts a patch antenna system 500 comprising a patch antenna 502 including a conductive patch 504 mounted on the upper surface 506 of an insulating dielectric member 508, and a conductive ground plane 510 mounted on the lower surface 512 of the dielectric member 508. The ground plane 510 is, thus, spaced from and parallel to the portion of the patch 504 disposed on the upper surface 506 of the dielectric member 508. The antenna 502 is configured as a "half-patch" wherein the patch 504 includes a first portion 514 carried on the upper surface 506 and a second portion 516 carried on a side edge wall 518 of the dielectric member 508. The second portion 516 is disposed at a right angle to both the first portion 514 and the ground plane 510 and electrically interconnects the patch 504 with the ground plane 510 along one edge of antenna 502. Alternatively, the patch 440 can overlay the entire upper surface 506.

The antenna 502 has a vertical feed pin (not illustrated) similar to that depicted in connection with FIG. 6. The antenna system 500 includes a plurality of vertical shorting pins 520 (only one is illustrated), each disposed in the dielectric member 508, and each electrically coupled at its upper end to the patch 504 and extending downwardly through an associated registering opening 522, respectively, formed in the ground plane 510. The lowermost end or terminus of each shorting pin 520 forms a contact pad 524. A discrete GaAs SPST bare-die type switch 526 is provided for selectively separately grounding the shorting pin contact pad 524 to the ground plane 510. The switch 526 has a bare-die 528 with a first active surface 530 facing the ground plane 510 and an opposed second active surface 532 facing away from the ground plane 510. A PCB 534 is adhesively bonded to the exposed lower surface 512 of the ground plane 510 adjacent each switch 526.

The first active surface 530 of each switch die 528 forms a first switch contact 536 interconnected to the associated contact pad 524 by a solder weldment such as a solder ball 538 and a second switch contact 540 interconnected to the ground plane 510 by a second weldment or solder ball 540. The second active surface 532 of each switch die 528 also forms a first i/o contact 544 interconnected to an associated first PBC contact 546 by a third weldment or solder ball 548 and a second i/o contact 550 interconnected to an associated second PBC contact 552 by a fourth weldment or solder ball 554. Contacts 544 and 550 are interconnected to conditioning or control circuitry (not illustrated) carried on the lower surface 556 of the PCB 534 by conductive traces 558 and 569, respectively. The conductive traces 558 and 560 are dressed on the upper surface 556 of the PCB 534 to connect with other conductive traces 570, surface mount components or semiconductor devices 564 via solder weldments 568 to supplemental contacts 566, or externally accessible connectors, such as spade terminals 232 which, in application, would be connected to a controller, as depicted in FIG. 3. The switch 526, as well as the electrical components 564 carried on the upper surface 556 of the PCB 534, are electrically insulated and protectively encased with an encapsulating layer 562 of non-conducting epoxy or the like.

The switches described herein constitute an ON/OFF switch providing Ohmic Switching (low and high resistance). The switch could be a FET, GaAs, CMOS solid-state or a MEMS switch. The invention described here also includes the case where the ON/OFF switches employed have a series capacitor (C), or an inductor (L) or a combination of L/C circuit inserted in series with the switch to provide Reactive Switching.

The invention also describes the case where the series reactive component referenced above (or the switch itself) is an analog or digital variable capacitor (varactor) or inductor controlled by the bias network.

The manufacturing solutions described in the eight embodiments of the invention depicted in (1.) FIGS. 1 and 2, (2.) FIGS. 3, 4A, 4B, 5 and 10-13, (3.) FIGS. 6 and 7, (4.) FIG. 8, (5.) FIG. 9, (6.) FIGS. 14 and 15, (7.) FIGS. 16 and 17, and (8.) FIG. 18, are simply repeated for the two cases above.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

Therefore, the manufacturing methods described are valid for other patch or micro-strip designs including full-patch and PIFA antennas.

The following documents are deemed to provide a fuller background of the inventions described herein and the manner of making and using same. Accordingly, each of the below-listed documents are hereby incorporated in the specification hereof by reference.

U.S. Patent Application Publication No. 2010/0194663 A1 to Rothwell et al. entitled "Variable Frequency Patch Antenna".

U.S. Pat. No. 7,385,557 B2 to Kim entitled "PIFA Device for Providing Optimized Frequency Characteristics in a Multi-Frequency Environment and Method for Controlling the Same".

U.S. Pat. No. 6,175,723 B1 to Rothwell III entitled "Self-Structuring Antenna System with a Switchable Antenna Array and an Optimizing Controller".

The invention claimed is:

1. A patch antenna system comprising:

a patch antenna having a patch, a ground plane, and a dielectric interposed between the patch and the ground plane, said ground plane forming a lower surface opposed from said dielectric;

at least one feed pin electrically coupled to the patch for transmitting and/or receiving signals;

a fixed number of shorting pins disposed in the dielectric and electrically coupled to the patch, said shorting pins irregularly juxtaposed and arranged in a non-uniformly spaced curvilinear fixed array extending away from said feed pin, each of at least a subset of said fixed number of shorting pins extending within an enlarged opening in said ground plane and forming a contact pad surface at a terminus thereof adjacent and electrically isolated from said ground plane, each said contact pad surface disposed substantially coplanar with said adjacent ground plane lower surface;

a fixed number of switches, wherein each switch has first and second Radio Frequency (RF) contact pads electrically connected to the ground plane lower surface and to an adjacent contact pad of an associated shorting pin, respectively, and first and second Direct Current (DC) bias/supply and control contacts electrically connected to a control module, said control module in communication with said fixed number of switches, and operable to reconfigure the patch antenna by selectively electrically connecting one or more of the fixed number of shorting pins to the ground plane, said control module effecting a complete binary count of a fixed number of switch states of said fixed number of switches to produce a substantially linear and monotonic shift in operating frequency of said patch antenna system throughout the patch antenna system's characteristic operating frequency range.

2. The patch antenna system of claim 1, wherein said patch antenna comprises a half-patch including a first surface portion disposed substantially parallel to said ground plane and a second portion disposed substantially normally to said ground plane.

3. The patch antenna system of claim 2, wherein said second surface portion electrically interconnects said first surface portion to an edge of said ground plane.

4. The patch antenna system of claim 2, wherein said second surface portion comprises a solid vertical conducting wall or an array of vias/plated through holes spaced less than 0.05 of the shortest wavelength within a characteristic operational frequency band of said antenna.

5. The patch antenna system of claim 1, wherein said patch antenna comprises a micro-strip antenna.

6. The patch antenna system of claim 1, wherein said shorting pins are arranged in a predetermined pattern encompassed by a fixed surface region of said patch.

7. The patch antenna system of claim 6, wherein the fixed surface region of the patch encompassing the shorting pins is substantially equal to the entire surface area of the patch.

8. The patch antenna system of claim 6, wherein the fixed surface region of the patch encompassing the shorting pins is less than 10% of the entire surface area of the patch.

9. The patch antenna system of claim 1, wherein said shorting pins are elongated, extending along an axis substantially normal to said patch.

10. The patch antenna system of claim 1, wherein said dielectric comprises ambient fluid or air.

11. The patch antenna system of claim 1, wherein said dielectric comprises an electrically insulating solid or semi-solid material.

12. The patch antenna system of claim 1, wherein at least some of said switches are disposed in a pre-packaged monolithic microwave integrated circuit.

13. The patch antenna system of claim 1, wherein at least one of said switches comprises a bare-die having a passive surface bonded either to said ground plane or to an exposed surface of a circuit substrate disposed adjacent said ground plane and wire-bonds interconnecting said switch contacts with said contact pad and said ground plane.

14. The patch antenna system of claim 1, wherein at least one of said switches comprises a bare-die having an active surface facing said ground plane and solder bonds interconnecting said switch contacts with said contact pad and said ground plane.

15. The patch antenna system of claim 1, wherein at least one of said switches comprises a bare-die having a first active surface facing said ground plane with solder bonds interconnecting said switch contacts with said contact pad and said ground plane, and a second active surface facing away from said ground plane forming i/o contacts.

16. The patch antenna system of claim 1, wherein each of said subset of said fixed number of shorting pins extend through said ground plane opening.

17. The patch antenna system of claim 1, wherein said shorting pin contact pads are generally disposed in a co-planer orientation with either a surface of said ground plane or a via contact pad facing away from said patch.

18. The patch antenna system of claim 1, wherein said control module is operable to set an operating frequency characteristic of the patch antenna by selectively electrically connecting one or more of the fixed number of shorting pins to the ground plane.

19. The patch antenna system of claim 1, wherein the switch contacts electrically connected to said ground plane are disposed adjacent an associated ground plane opening.

20. An RF communication device comprising:

a transmitter and/or receiver circuit assembly having a substrate and a fixed number of electrical/electronic components and conductors carried thereon;

a patch antenna surface mounted on said substrate, said patch antenna having a patch, a ground plane, and a dielectric interposed between the patch and the ground plane, said ground plane forming a lower surface opposed from said dielectric;

at least one feed pin electrically coupled to the patch for transmitting and/or receiving signals from/to said circuit assembly;

a fixed number of shorting pins disposed in the dielectric and electrically coupled to the patch, said shorting pins irregularly juxtaposed and arranged in a non-uniformly spaced curvilinear array extending away from said feed pin, each of at least a subset of said fixed number of shorting pins extending within an enlarged opening in said ground plane and forming a contact pad surface at a terminus thereof adjacent and electrically isolated from said ground plane, each said contact pad surface disposed substantially coplanar with said adjacent ground plane lower surface;

a fixed number of switches, wherein each switch has first and second Radio Frequency (RF) contact pads electrically connected to the ground plane lower surface and to an adjacent contact pad of an associated shorting pin, respectively, and first and second Direct Current (DC) bias/supply and control contacts electrically connected to a control module, said control module in communication with said fixed number of switches, and operable to reconfigure the patch antenna by selectively electrically connecting one or more of the fixed number of shorting pins to the ground plane, said control module effecting a complete binary count of a fixed number of switch states of said fixed number of switches to produce a substantially linear and monotonic shift in operating frequency of said patch antenna system throughout the patch antenna system's characteristic operating frequency range.

21. The RF communication device of claim 20, wherein said substrate comprises said dielectric.

22. The RF communication device of claim 20, wherein said substrate comprises a multi-layer PCB.

23. The RF communication device of claim 20, wherein said patch is carried on the uppermost surface of the top PCB layer and the ground plane is carried on the lowermost surface of the bottom PCB layer.

24. A method of fabricating a patch antenna system comprising the steps of:

providing a patch antenna having a patch, a ground plane, and a dielectric interposed between the patch and the ground plane, wherein said ground plane forms a lower surface opposed from said dielectric;

providing at least one feed pin electrically coupled to the patch for transmitting and/or receiving signals;

providing a fixed number of shorting pins disposed in the dielectric and electrically coupled to the patch, said shorting pins irregularly juxtaposed and arranged in a non-uniformly spaced curvilinear fixed array extending away from said feed pin, each of at least a subset of said fixed number of shorting pins extending within an enlarged opening in said ground plane and forming a contact pad surface at a terminus thereof adjacent and electrically isolated from said ground plane, each said contact pad surface disposed substantially coplanar with said adjacent ground plane lower surface; and providing a fixed number of switches, wherein each switch includes first and second Radio Frequency (RF) contact pads electrically connected to the ground plane lower surface and to an adjacent contact pad of an associated shorting pin, respectively, and first and second Direct Current (DC) bias/supply and control contacts electrically connected to a control module, wherein said control module in communication with said fixed number of switches, and operable to reconfigure the patch antenna by selectively electrically connecting one or more of the fixed number of shorting pins to the ground plane, said control module effecting a complete binary count of a fixed number of switch states of said fixed number of switches to produce a substantially linear and monotonic shift in operating frequency of said patch antenna system throughout the patch antenna system's characteristic operating frequency range.

25. The method of claim 24, further comprising the steps of:

forming a through passage in said ground plane in concentric alignment with the terminus of an associated shorting pin; and extending each shorting pin through its associated through passage, wherein said shorting pin contact pad is substantially coplanar with said ground plane.

26. The method of claim 24, further comprising the step of pre-packaging at least a fixed number of said switches in a monolithic microwave integrated circuit which is bonded to the ground plane of the patch antenna employing a flip-chip/solder bump method, and which also encompasses wiring interconnecting the control contacts of the switches to a control module.

27. The method of claim 24, further comprising the steps of configuring at least one of said switches as a bare-die, and wire-bonding or solder-bonding via a flip-chip method first and second RF contact pads to the ground plane lower surface and to an adjacent contact pad of an associated shorting pin, respectively, and first and second DC bias and control contacts to DC signal traces realized on a second PCB with two sides, whose ground plane side is electrically bonded to and partially covering the ground plane of the patch antenna up to the point where the switches are located housing conductive traces on its opposing side facing away from the antenna, carrying DC control signals from the control module.

28. The method of claim 24, further comprising the steps of configuring at least one of said switches as a bare-die having an active surface facing said ground plane, and solder bonding said switch contacts with said contact pad and said ground plane.

29. The method of claim 24, further comprising the steps of configuring at least one of said switches as a bare-die having a first active surface facing said ground plane with solder bonds interconnecting said switch contacts with said contact pad and said ground plane, and a second active surface facing away from said ground plane forming i/o contacts.

30. The method of claim 24, further comprising the step of configuring each of said subset of said fixed number of shorting pins to extend through associated ground plane openings.

31. The method of claim 24, further comprising the step of positioning said shorting pin contact pads in a generally co-planer orientation with either a surface of said ground plane or a via contact pad facing away from said patch.

32. The method of claim 24, further comprising the step of positioning the switch contacts electrically connected to said ground plane adjacent an associated ground plane opening.

* * * * *